US010746386B2

(12) United States Patent
Horst et al.

(10) Patent No.: US 10,746,386 B2
(45) Date of Patent: Aug. 18, 2020

(54) LIGHTING SYSTEM AND METHOD OF USE

(71) Applicant: Oelo LLC, Fort Collins, CO (US)

(72) Inventors: Clay Horst, Loveland, CO (US); Ron Weinmeister, Fort Collins, CO (US)

(73) Assignee: Oelo LLC, Fort Collins, CO (US)

( * ) Notice: Subject to any disclaimer, the term of this patent is extended or adjusted under 35 U.S.C. 154(b) by 0 days.

(21) Appl. No.: 16/450,354

(22) Filed: Jun. 24, 2019

(65) Prior Publication Data

US 2019/0331327 A1 Oct. 31, 2019

Related U.S. Application Data

(63) Continuation of application No. 16/007,533, filed on Jun. 13, 2018, now Pat. No. 10,371,363, which is a continuation of application No. 14/632,113, filed on Feb. 26, 2015, now Pat. No. 10,006,615.

(60) Provisional application No. 62/005,464, filed on May 30, 2014.

(51) Int. Cl.

| | |
|---|---|
| ***F21V 23/00*** | (2015.01) |
| ***F21V 31/00*** | (2006.01) |
| ***F21V 21/005*** | (2006.01) |
| ***F21S 2/00*** | (2016.01) |
| ***H05B 45/20*** | (2020.01) |
| ***F21V 3/04*** | (2018.01) |
| ***F21S 8/00*** | (2006.01) |
| ***F21Y 115/10*** | (2016.01) |
| ***F21Y 113/13*** | (2016.01) |
| *F21W 131/107* | (2006.01) |

(52) U.S. Cl.

CPC ..... *F21V 23/005* (2013.01); *F21S 2/005* (2013.01); *F21V 21/005* (2013.01); *F21V 23/009* (2013.01); *F21V 31/005* (2013.01); *H05B 45/20* (2020.01); *F21S 8/036* (2013.01); *F21V 3/04* (2013.01); *F21W 2131/107* (2013.01); *F21Y 2113/13* (2016.08); *F21Y 2115/10* (2016.08)

(58) Field of Classification Search

CPC ..... F21V 21/005; F21V 31/005

See application file for complete search history.

(56) References Cited

U.S. PATENT DOCUMENTS

| | | | | |
|---|---|---|---|---|
| 7,815,338 | B2 * | 10/2010 | Siemiet | F21V 3/02 362/218 |
| 9,423,116 | B2 * | 8/2016 | Sieberth | F21V 23/06 |
| 2012/0250309 | A1 * | 10/2012 | Handsaker | F21V 5/04 362/235 |
| 2015/0267899 | A1 * | 9/2015 | Baright | F21V 15/01 362/223 |
| 2016/0338166 | A1 * | 11/2016 | Knaapen | H05B 33/0845 |

* cited by examiner

*Primary Examiner* — William N Harris
(74) *Attorney, Agent, or Firm* — Talus Law Group LLC

(57) ABSTRACT

The present invention provides a lighting system. The lighting system may be mounted to the eaves of a building structure, such as a residential home. An additional aspect of the present invention is to provide a modular, adaptable and programmable lighting system and method for building a lighting system. Further, the lighting system may be provided in a waterproof or water-resistant enclosure.

12 Claims, 24 Drawing Sheets

LIGHTING SYSTEM AND METHOD OF USE

CROSS REFERENCE TO RELATED APPLICATIONS

The present application is a continuation application of U.S. patent application Ser. No. 16/007,533, filed Jun. 13, 2018, which claims priority to U.S. patent application Ser. No. 14/632,113, filed Feb. 26, 2015, which claims priority to U.S. Provisional Application Ser. No. 62/005,464, filed on May 30, 2014, entitled "Lighting System and Method of Use," the entire disclosure of each of which are hereby incorporated by reference, in their entirety, for all purposes.

FIELD OF THE INVENTION

Embodiments of the present invention are generally related to a lighting system, and, in particular, to a modular, adaptable and programmable lighting system and method of use.

BACKGROUND OF THE INVENTION

Existing lighting systems for building exteriors are typically difficult to install and not adaptable to a particular application. Traditional exterior lighting systems are custom-made and require skilled labor for installation. In practice such systems are difficult if not impossible to modify to provide alternative lighting presentations, such as alternative lighting colors, lighting brightness and on/off frequencies.

Some attempts have been made to provide improved exterior lighting. For example, U.S. Patent Application Publication No. 2012/0250309 to Handsaker ("Handsaker I") published Oct. 4, 2012, discloses a lighting fixture utilizing light emitting diodes and reconfigurable lenses to provide customizable lighting patterns to more efficiently illuminate work or storage areas. However, Handsaker I, among other things, does not provide a modular system. Handsaker I is incorporated herein by reference in its entirety. U.S. Pat. No. D532,919 to Handsaker et al. ("Handsaker II") issued Nov. 28, 2006 is an ornamental design for a light fixture. Handsaker II is incorporated herein by reference in its entirety.

U.S. Pat. No. 8,231,245 to Weimer et al. ("Weimer") issued Jul. 31, 2012 relates to a light emitting diode lighting fixture. In one embodiment, the light fixture includes an extrusion, a plurality of light emitting diodes (LEDs) and a lens coupled to the extrusion. The plurality of LEDs has a uniform spacing between each one of the plurality of LEDs along the extrusion. Weimer does not provide, among other things, a modular, adaptable and programmable lighting system. Weimer is incorporated herein by reference in its entirety.

U.S. Patent Application Publication No. 2011/0292652 to Huang et al. ("Huang I") published Dec. 1, 2011 includes a body portion having a lighting module and an optical structure formed integrally with the body portion. The optical structure is formed within the body portion and located in a light-projection direction of the lighting module. The optical structure substantially is a sheet-like structure with a first surface and a second surface. The first surface has at least two side portions with a first curvature, and the second surface has a second curvature. The first curvature is greater than the second curvature. Thereby, the view angle of the light is increases as the light generated from the lighting module passes through the optical structure. However, Huang I does not provide, among other things, a modular, adaptable and programmable lighting system. Huang I is incorporated herein by reference in its entirety.

U.S. Pat. No. 6,149,288 to Huang ("Huang II") issued Nov. 21, 2000 discloses a vehicle light assembly for use with a vehicle comprising a base plate, a detachable and replaceable circuit board and a lens attached to the base for covering the circuit board. The base plate has plug-in terminal connectors. Each terminal connector has a prong which extends upwardly from the base plate and a socket which extends downwardly from the base plate for connecting to a power source. The circuit board has illuminating members and ring connectors which are coupled to the illuminating members. The circuit board is installed on the base plate such that the plug-in terminal connectors on the base plate are respectively inserted into the ring connectors of the circuit board for providing electrically continuity. Therefore, when the circuit board malfunctions, the circuit board is easily replaceable by removing the lens and then the circuit board, where the old circuit board is replaced with a new circuit board, without replacing the entire light assembly and rewiring the circuit board to the electrical wiring of the vehicle. Huang II does not provide, among other things, a modular, adaptable and programmable lighting system. Huang II is incorporated herein by reference in its entirety.

U.S. Pat. No. 7,914,162 to Huang ("Huang III") issued Mar. 29, 2011 discloses a light assembly including a housing, a plurality of light emitting diodes (LED) on a circuit board, a lens, a lens cover and a heating board positioned within the housing. The heating board is positioned behind the lens and in front of LEDs within the housing, such that light from the LEDs shines through the heating board. The heating board also includes a sensor and a microcontroller to activate, deactivate and control the heating board in response to an outside air temperature. Huang III does not provide, among other things, a modular, adaptable and programmable lighting system. Huang III is incorporated herein by reference in its entirety.

U.S. Patent Application Publication No. 2008/0192478 to Chen ("Chen") published Aug. 14, 2008 discloses light-emitting diode illuminating equipment, including a heat-dissipating plate device, a plurality of heat-conducting devices, a plurality of diode light-emitting apparatuses, a plurality of optical devices, and a hollow barrel. The hollow barrel is engaged to the heat-dissipating plate device to form a space for accommodating the heat-conducting devices, the diode light-emitting apparatuses, and the optical devices. Each of the diode light-emitting apparatuses corresponds to one of the heat-conducting devices. Each of the optical devices corresponds to at least one of the diode light-emitting apparatuses and modulates a light pattern of the corresponding diode light-emitting apparatus. In an embodiment, each of the optical devices includes a cat's-eye-like lens. The cat's-eye-like lens includes a surface, where a groove is formed along an ellipse minor axis of the lens, such that the light transmitted through the lens can form a light pattern for a specific request. Chen does not provide, among other things, a modular, adaptable and programmable lighting system. Chen is incorporated herein by reference in its entirety.

U.S. Patent Application Publication No. 2008/0219002 to Sommers et al. ("Sommers") published Sep. 11, 2008 discloses an LED lamp for use in a display case includes a plurality of LEDs and an optic for redirecting the light to illuminate the contents of the display case. Sommers does not provide, among other things, a modular, adaptable and programmable lighting system. Sommers is incorporated herein by reference in its entirety.

U.S. Patent Application Publication No. 2008/0273325 to Wilcox et al., ("Wilcox") published Nov. 6, 2008 discloses an LED apparatus of the type having a mounting board, an LED package thereon with a primary lens, and a secondary lens member over the primary lens. The device establishes a light path and includes a resilient member against the secondary lens member in position other than in the light path, the resilient member yieldingly constraining the secondary lens member and accommodating secondary lens member movement caused by primary lens thermal expansion during operation. Wilcox does not provide, among other things, a modular, adaptable and programmable lighting system. Wilcox is incorporated herein by reference in its entirety.

U.S. Patent Application Publication No. 2011/0261566 to Boulton ("Boulton") published Oct. 27, 2011 relates to exterior lighting systems. More particularly, Boulton relates to a track lighting system with independently remotely controlled light modules. Boulton does not provide, among other things, a modular, adaptable and programmable lighting system. Boulton is incorporated herein by reference in its entirety.

U.S. Patent Application Publication No. 2012/0055902 to Park et al., ("Park") published Mar. 8, 2012 discloses a method for finishing an exterior surface of an injection-molded product in which a metal layer is formed on the exterior surface of the injection-molded product. A photoresist layer is formed on the metal layer, a photomask is placed on the photoresist layer, light is projected onto the photomask, and remaining parts of the metal layer and the photoresist layer except for parts corresponding to a pattern formed on the photomask are removed by etching. Park does not provide, among other things, a modular, adaptable and programmable lighting system. Park is incorporated herein by reference in its entirety.

U.S. Patent Application Publication No. 2002/0191391 to Van Etten ("Van Etten") published Dec. 19, 2002 discloses several matching exterior lighting systems for use on property having electrical service wiring. Lighting fixtures are made of pipe or wood, preferably PVC pipe or redwood. Several embodiments can be installed directly in the ground, while other embodiments can be installed on the vertical exterior surface of a building, or on the top of a wall. In all embodiments, the lamp and electrical connections are housed within the same enclosure and the structure of the lighting fixture provide for direct mounting to the environment without intermediary elements that are not part of the structure, and no separate electrical box is needed. The embodiments made of pipe are coated with stucco, brick, stone, tile, wood, aluminum sheet, or copper sheet, to protect the pipe from environmental degradation and permit greater aesthetic appeal and incorporation into the environment. The preferred coating is stucco, and the invention includes a new method of applying stucco to a circular cylinder and manufacturing an article. The circular embodiments each have a single lens that covers all of the windows. In several embodiments, the fluorescent light and light bulbs can be accessed by removing the top of the light and lifting out the lamp, which is hung from the top. Van Etten does not provide, among other things, a modular, adaptable and programmable lighting system. Van Etten is incorporated herein by reference in its entirety.

What is needed is a lighting system and method of use that is readily mounted, modular, adaptable and programmable to allow user-selectable lighting configurations. This disclosure solves this unmet need.

SUMMARY OF THE INVENTION

The disclosure relates to a modular, adaptable and programmable lighting system and method of use. In one embodiment of the invention, a modular lighting system is disclosed, the system comprising: a first linear portion having a first end, a second end, a base housing, and a cover, the base housing and cover forming a cavity; a circuit board in electrical communication with an electrical power source and configured to fit within the cavity, the circuit board comprising at least one lighting source; and a controller configured to control the circuit board and the at least one lighting source; wherein each of the first end and the second end are configured to engage at least one of an extension adaptor and a terminal adaptor, the extension adaptor configured to connect the first linear portion with a second linear portion.

In another embodiment of the invention, a waterproof lighting system is disclosed, the system comprising: a first linear portion having a first end, a second end, a base housing, and a cover, the base housing and cover forming a cavity; a circuit board configured to fit within the cavity, the circuit board comprising at least one LED; and a controller in communication with the circuit board and configured to control the circuit board and the at least one LED; wherein each of the first end and the second end are configured to engage each of an extension adaptor and a terminal adaptor, the extension adaptor configured to connect the first linear portion with a second linear portion.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

A "communication channel" refers to an analog and/or digital physical transmission medium such as cable (twisted-pair wire, cable, and fiber-optic cable) and/or other wireline transmission medium, and/or a logical and/or virtual connection over a multiplexed medium, such microwave, satellite, radio, infrared, or other wireless transmission medium. A communication channel is used to convey an information signal, for example a digital bit stream, from one or several senders (or transmitters) to one or several receivers. A communication channel has a certain capacity for transmitting information, often measured by its bandwidth in Hz or its data rate in bits per second. Communication channel performance measures that can be employed in determining a quality or grade of service of a selected channel include spectral bandwidth in Hertz, symbol rate in baud, pulses/s or symbols/s, digital bandwidth bit/s measures (e.g., gross bit rate (signaling rate), net bit rate (information rate), channel capacity, and maximum throughput), channel utilization, link spectral efficiency, signal-to-noise ratio measures (e.g., signal-to-interference ratio, Eb/No, and carrier-to-interference ratio in decibel), bit-error rate (BER), packet-error rate (PER), latency in seconds, propagation time, transmission time, and delay jitter.

The terms "communication device," "smartphone," and "mobile device," and variations thereof, as used herein, are used interchangeably and include any type of device capable of communicating with one or more of another device and/or across a communications network, via a communications protocol, and the like. Exemplary communication devices may include but are not limited to smartphones, handheld computers, laptops, netbooks, notebook computers, subnotebooks, tablet computers, scanners, portable gaming devices, phones, pagers, GPS modules, portable music players, and other Internet-enabled and/or network-connected devices.

A "communication modality" refers to a protocol- or standard defined or specific communication session or interaction, such as Voice-Over-Internet-Protocol ("VoIP), cellular communications (e.g., IS-95, 1G, 2G, 3G, 3.5G, 4G, 4G/IMT-Advanced standards, 3GPP, WIMAX™, GSM, CDMA, CDMA2000, EDGE, 1×EVDO, iDEN, GPRS, HSPDA, TDMA, UMA, UMTS, ITU-R, and 5G), Bluetooth™, text or instant messaging (e.g., AIM, Blauk, eBuddy, Gadu-Gadu, IBM Lotus Sametime, ICQ, iMessage, IMVU, Lync, MXit, Paltalk, Skype, Tencent QQ, Windows Live Messenger™ or MSN Messenger™, Wireclub, Xfire, and Yahoo! Messenger™), email, Twitter (e.g., tweeting), Digital Service Protocol (DSP), and the like.

The term "communication system" or "communication network" and variations thereof, as used herein, refers to a collection of communication components capable of one or more of transmission, relay, interconnect, control, or otherwise manipulate information or data from at least one transmitter to at least one receiver. As such, the communication may include a range of systems supporting point-to-point to broadcasting of the information or data. A communication system may refer to the collection individual communication hardware as well as the interconnects associated with and connecting the individual communication hardware. Communication hardware may refer to dedicated communication hardware or may refer a processor coupled with a communication means (i.e., an antenna) and running software capable of using the communication means to send a signal within the communication system. Interconnect refers some type of wired or wireless communication link that connects various components, such as communication hardware, within a communication system. A communication network may refer to a specific setup of a communication system with the collection of individual communication hardware and interconnects having some definable network topography. A communication network may include wired and/or wireless network having a pre-set to an ad hoc network structure.

The term "computer-readable medium" as used herein refers to any tangible storage and/or transmission medium that participate in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored.

The terms "determine", "calculate" and "compute," and variations thereof, as used herein, are used interchangeably and include any type of methodology, process, mathematical operation or technique.

The term "display" refers to a portion of a screen used to display the output of a computer to a user.

The term "displayed image" or "displayed object" refers to an image produced on the display. A typical displayed image is a window or desktop or portion thereof, such as an icon. The displayed image may occupy all or a portion of the display.

The term "electronic address" refers to any contactable address, including a telephone number, instant message handle, e-mail address, Universal Resource Locator ("URL"), Universal Resource Identifier ("URI"), Address of Record ("AOR"), electronic alias in a database, like addresses, and combinations thereof.

The term "in communication with," as used herein, refers to any coupling, connection, or interaction using electrical signals to exchange information or data, using any system, hardware, software, protocol, or format, regardless of whether the exchange occurs wirelessly or over a wired connection.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The term "module" as used herein refers to any known or later developed hardware, software, firmware, artificial intelligence, fuzzy logic, or combination of hardware and software that is capable of performing the functionality associated with that element. Also, while the disclosure is presented in terms of exemplary embodiments, it should be appreciated that individual aspects of the disclosure can be separately claimed.

The term "screen," "touch screen," or "touchscreen" refers to a physical structure that enables the user to interact with the computer by touching areas on the screen and provides information to a user through a display. The touch screen may sense user contact in a number of different ways, such as by a change in an electrical parameter (e.g., resistance or capacitance), acoustic wave variations, infrared radiation proximity detection, light variation detection, and the like. In a resistive touch screen, for example, normally separated conductive and resistive metallic layers in the screen pass an electrical current. When a user touches the screen, the two layers make contact in the contacted location, whereby a change in electrical field is noted and the coordinates of the contacted location calculated. In a capacitive touch screen, a capacitive layer stores electrical charge, which is discharged to the user upon contact with the touch screen, causing a decrease in the charge of the capacitive layer. The decrease is measured, and the contacted location coordinates determined. In a surface acoustic wave touch screen, an acoustic wave is transmitted through the screen, and the acoustic wave is disturbed by user contact. A receiving transducer detects the user contact instance and determines the contacted location coordinates. The touch screen may or may not include a proximity sensor to sense a nearness of object, such as a user digit, to the screen.

The term "fascia" or variations thereof refer to a frieze or band running below a roof edge, typically mounted in a flat configuration perpendicular to the ground.

The term "eave" or variations thereof refer to the edge of a roof and in particular to the projecting overhang at the lower edge of a roof.

The term "waterproof" or "watertight" or variations thereof means impervious to or unaffected by water.

The term "water resistant" or variations thereof means resistant to damage by water.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference letter or label.

It should be understood that the drawings are not necessarily to scale unless specifically so indicated. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-10 depict various views of the modular, adaptable and programmable lighting system 100 (aka "system" or "device") and components or sub-assemblies thereof. Generally, the system 100 comprises a linear portion (LP) 200 which connects, at one or both ends, to a terminal adaptor portion (TAP) 300 or an extension adaptor portion (400) and is in communication with a controller 500.

Figure 1A:
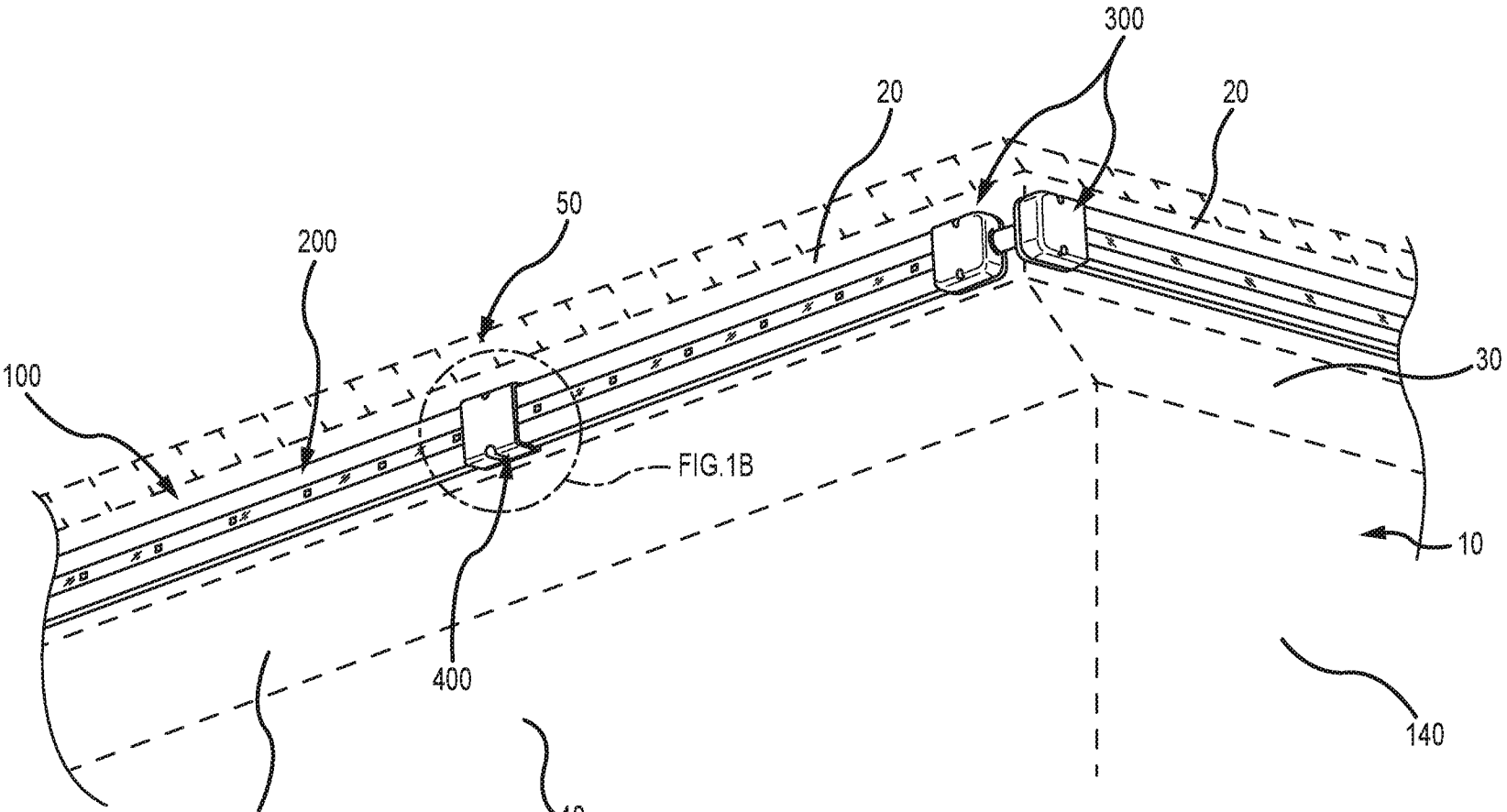
FIG. 1A depicts the lighting system according to one embodiment of the present invention as installed on the fascia of a building.
Figure 1B:
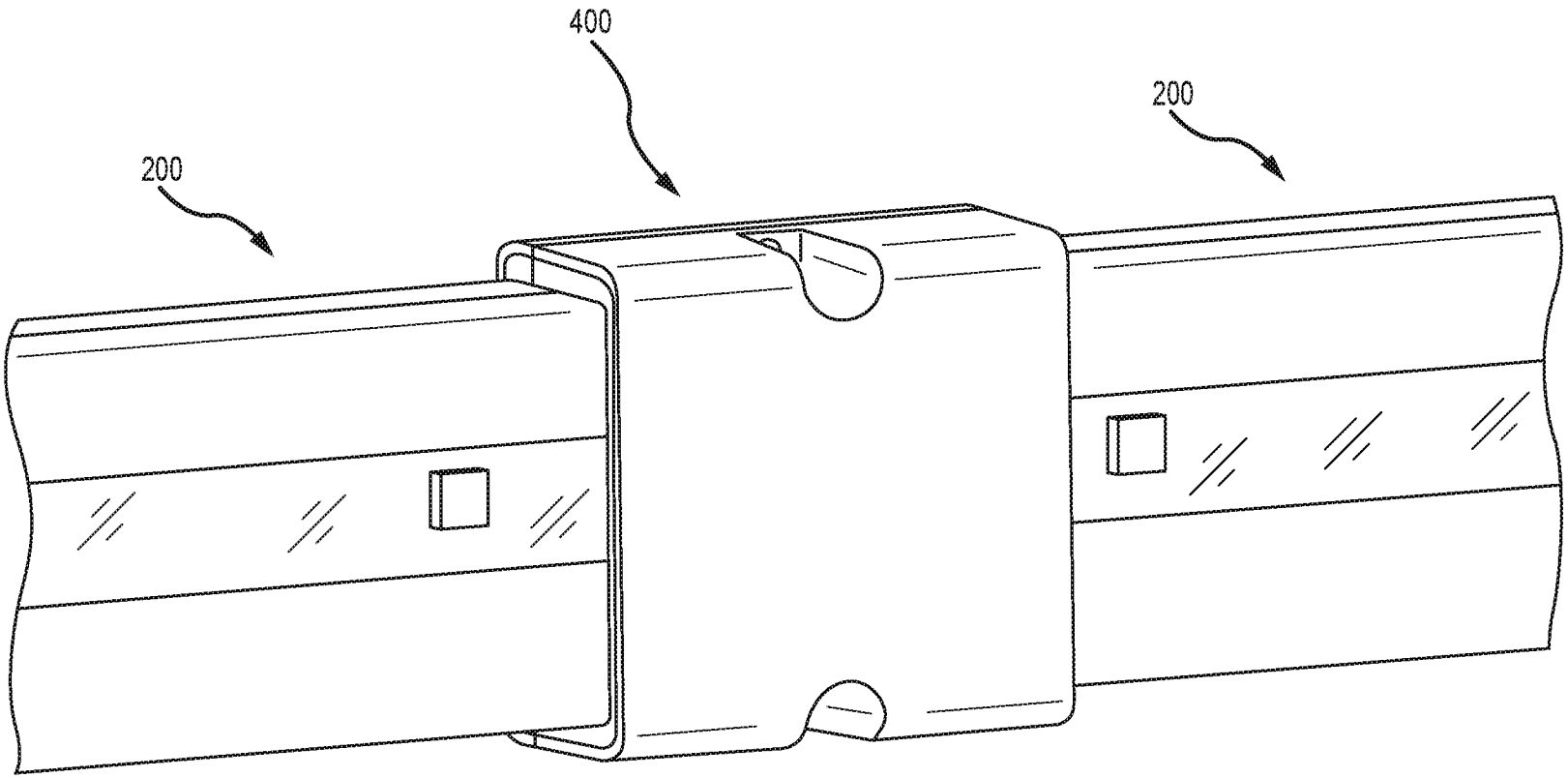
FIG. 1B depicts a detail of a portion of the lighting system of FIG. 1A.
Figure 1C:
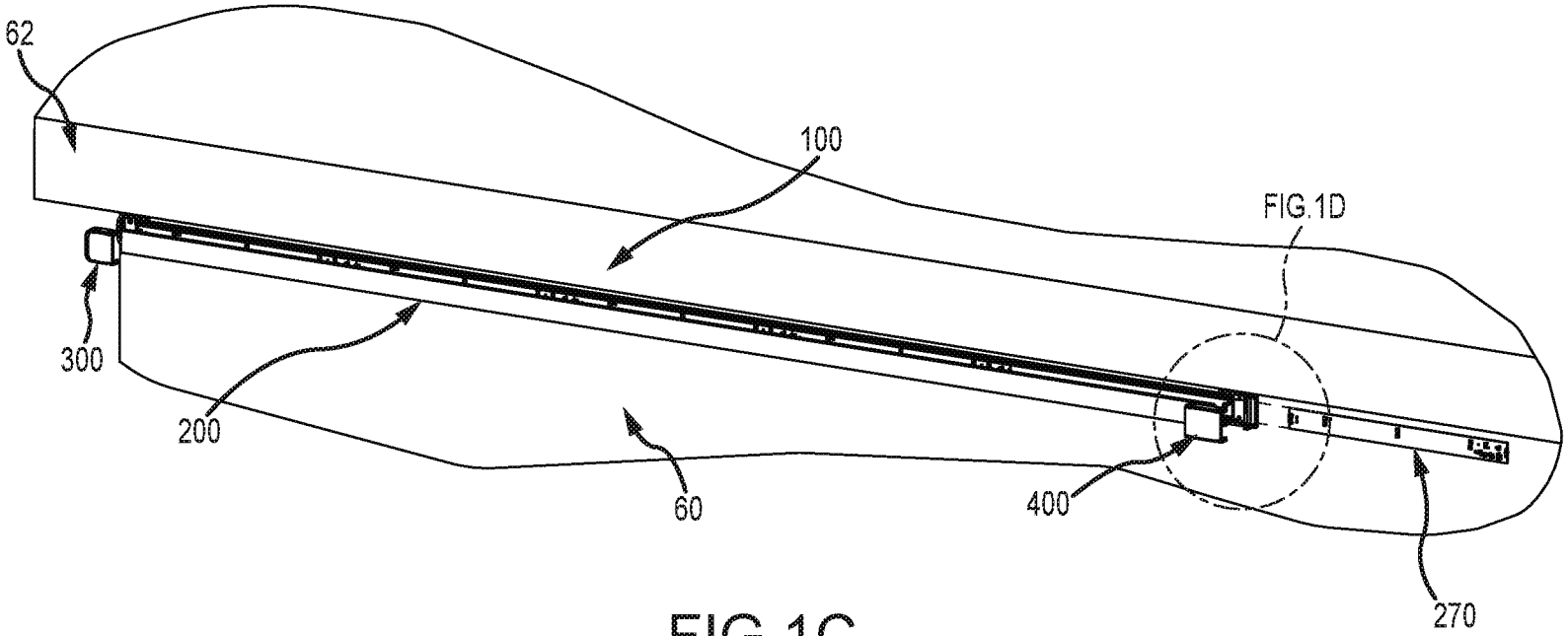
FIG. 1C depicts the lighting system according to one embodiment of the present invention as installed on the wall of a building.

As shown in FIG. 1A, the system 100 may mount to the fascia 20 of a building 10, above the eaves 30 and below the roof 50. Alternatively, the system 100 may be mounted to an overhand 62 of a wall 60, as depicted in FIG. 1C. Generally, a given installation of the system 100 will include one or more an extension adaptor portions (400) which connect a pair of linear portions (LP) 200, and one or more terminal adaptor portions (TAP) 300 which are fitted to the ends of linear portions (LP) 200.

Each of the components of the system 100 are configured to be easily installed, e.g. by way of screws, nails or other means know to those skilled in the art, and provide a substantially or completely waterproof system 100. Furthermore, the system 100 components are configured to be modular, i.e. the core components of the linear portion (LP) 200, terminal adaptor portion (TAP) 300 and extension adaptor portion (400) may be fitted to one another so as to provide a system 100 of configurable length (e.g. by fitting a given number of linear portions 200) and/or geometry (e.g. by including various bends between a pair of linear portions 200). See, e.g. FIG. 1A. An LP circuit board 270, which fits within a linear portion (LP) 200, provides programmable lighting via controller 500.

Figure 1D:
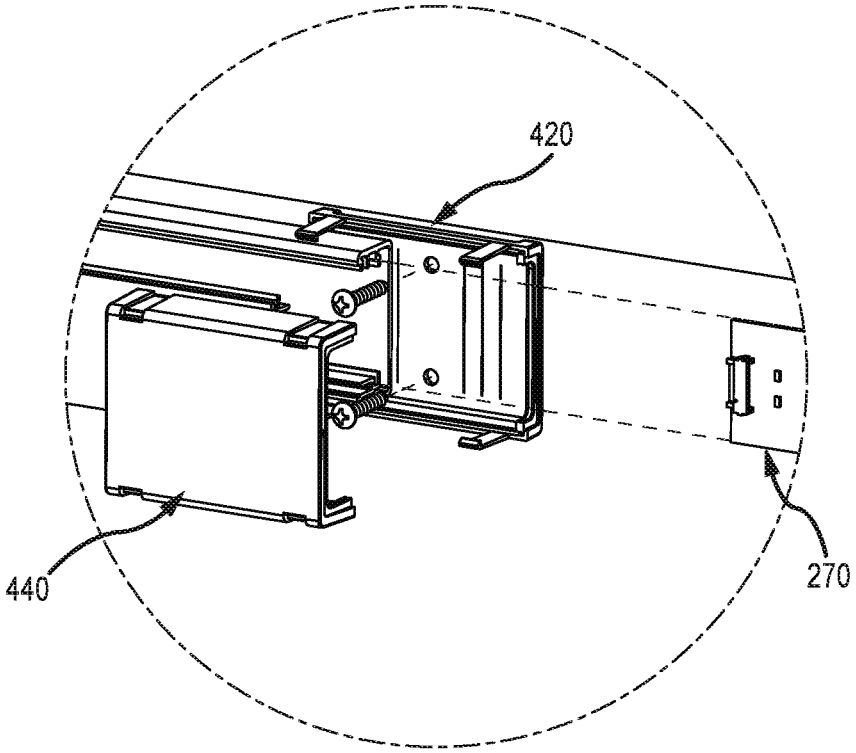
FIG. 1D depicts a detail of a portion of the lighting system of FIG. 1C.
Figure 1E:
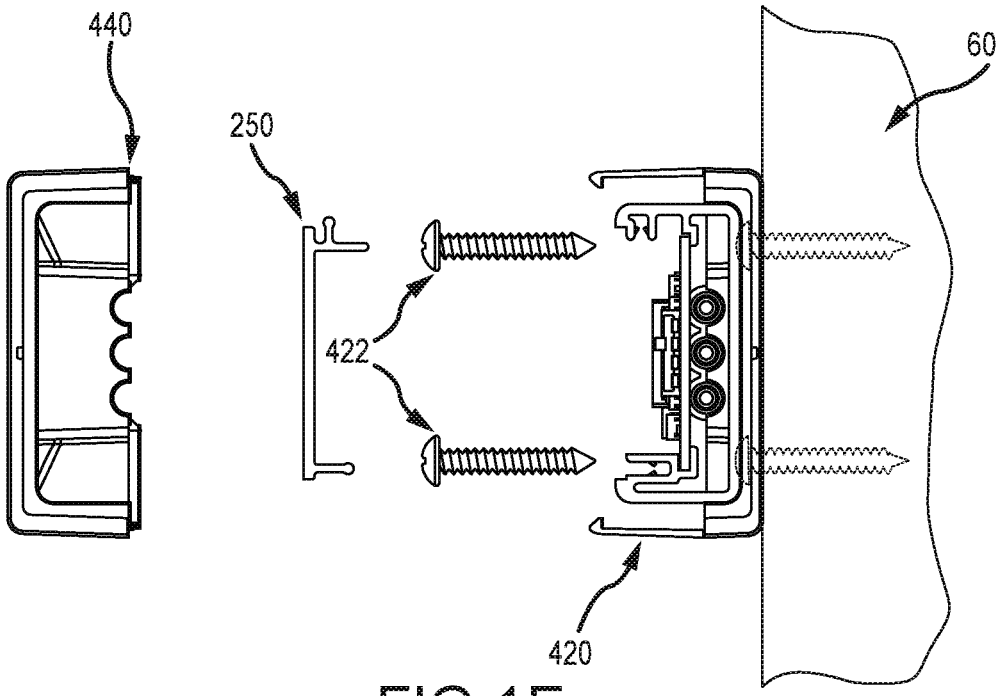
FIG. 1E depicts a detail of a portion of the lighting system of FIG. 1C.
Figure 2B:
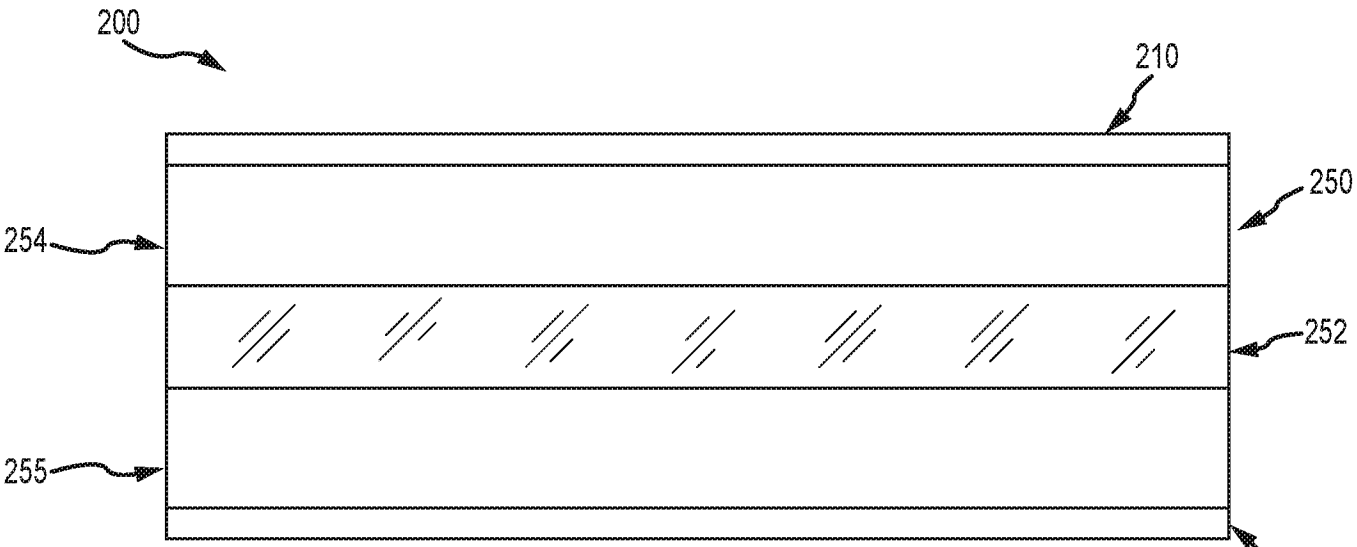
FIG. 2B depicts a top plan view of the linear portion of the lighting system of FIG. 2A according to one embodiment of the present invention.
Figure 2C:
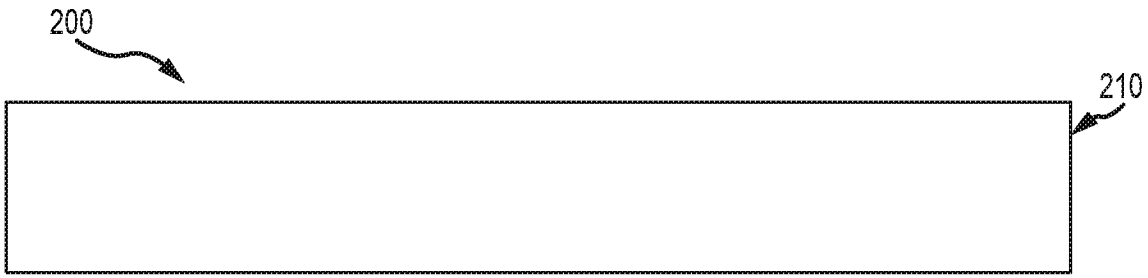
FIG. 2C depicts a right side elevation view of the linear portion of the lighting system of FIG. 2A according to one embodiment of the present invention.
Figure 2A:
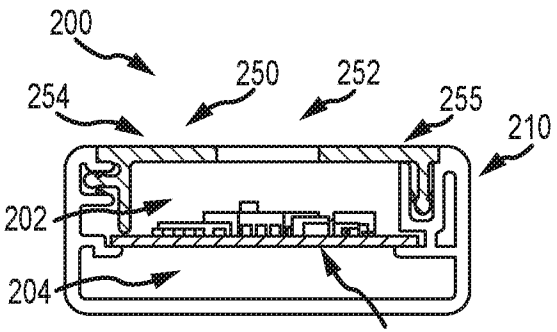
FIG. 2A depicts a front elevation view of the linear portion of the lighting system of FIG. 1A according to one embodiment of the present invention.
Figure 2E:
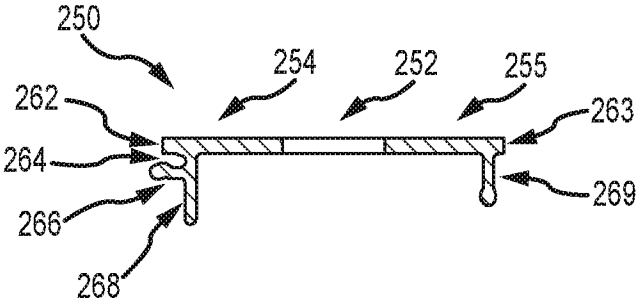
FIG. 2E depicts a front elevation view of the cover portion of the lighting system of FIG. 2A according to one embodiment of the present invention.
Figure 2D:
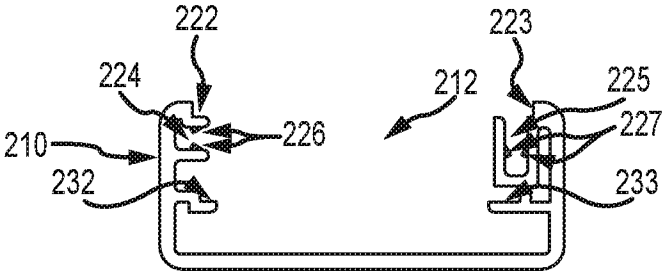
FIG. 2D depicts a front elevation view of the housing portion of the lighting system of FIG. 2A according to one embodiment of the present invention.
Figure 2G:
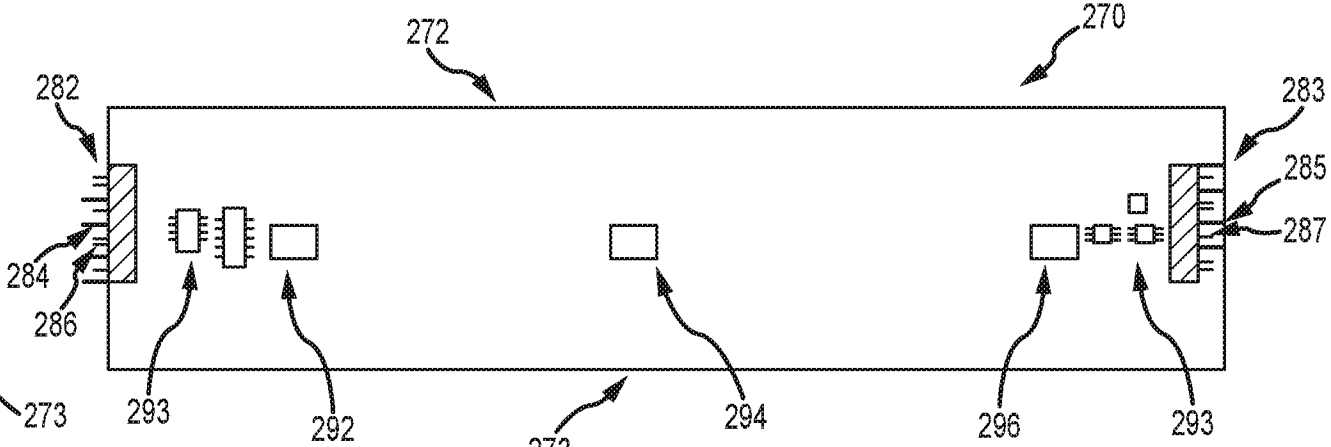
FIG. 2G depicts a top plan view of the circuit board portion of the lighting system of FIG. 2A according to one embodiment of the present invention.
Figure 2F:
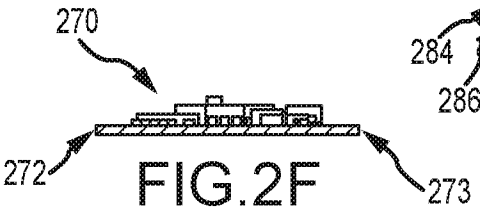
FIG. 2F depicts a front elevation view of the circuit board portion of the lighting system of FIG. 2A according to one embodiment of the present invention.

With particular attention to FIGS. 1C-E, the mounting of LP circuit board 270 and the extension adaptor portion (400) to a wall 60 is depicted. LP circuit board 270 slidably engages a track molded or fitted within linear portion 200, as will be described in more detail below. Extension adaptor portion (EAP) 400 comprises EAP base 420, EAP lid 440 and one or more EAP mounting screws 422. The EAP mounting screws 422 run through pre-cut apertures in EAP base 420 so as to secure the extension adaptor portion (EAP) 400 to the wall 60. EAP lid 440 fits to EAP base 420 by way of extension tongues fitted to EAP base 420 which extend over the exterior of EAP lid 440.

With particular attention to FIGS. 2A-G, further details of the linear portion 200 are provided. The linear portion 200 generally comprises LP housing 210, LP circuit board 270, and LP cover 250. The LP housing 210 is generally U-shaped and configured to engage the LP cover 250 such that the LP cover 250 is secured at the top of the U-shaped LP housing 210 to form a rectangular exterior cross-section. The LP housing 210 is further configured to receive the LP circuit board 270 within an interior void or space or cavity of the LP housing 210 wherein the LP circuit board 270 rests on opposing tracks or mounts of shelves disposed within the cavity of the LP housing 210. The LP circuit board 270 is configured to emit light through the LP cover 250.

The LP housing 210 comprises an LP housing interior 212, LP first circuit board shelf mount 232 and LP second circuit board shelf mount 233. The LP circuit board 270 is mounted within the LP housing interior 212 on each of the LP first circuit board shelf mount 232 and LP second circuit board shelf mount 233, wherein the LP circuit board first side 272 engages, or rests on, the LP first circuit board shelf mount 232, and the LP circuit board second side 273 engages, or rests on, the LP second circuit board shelf mount 233. Note that the LP second circuit board shelf mount 233 forms a cavity around the LP circuit board second side 273, while the LP first circuit board shelf mount 232 simply forms a shelf. Once the LP circuit board 270 is mounted within the LP housing 210, an LP second cavity 204 is defined below the LP circuit board 270 and above the bottom interior of the LP housing 210.

The LP housing 210 further comprises adjacent interior elements to engage and secure the LP cover 250. That is, the LP housing 210 comprises LP first cover shelf mount 222 which engages LP cover first shelf 262 and LP cover first horizontal void 264, and LP first cover receiver void 224 and LP first cover receiver gripper 226 which engage LP cover extension 266 and LP cover first vertical extension 268. Also, the LP housing 210 comprises LP second cover shelf mount 223, which comprises LP cover second receiver void 225 and LP second cover receiver grippers 227. LP cover second shelf 263 engages LP second cover shelf mount 223, and LP cover second vertical extension 269 engages LP cover second receiver void 225 and LP second cover receiver grippers 227. Once the LP cover 250 is mounted to the top of the LP housing 210, an LP first cavity 210 is defined below the LP cover 250 and above the LP circuit board 270. Also, the installed LP cover 250 presents an LP cover first vertical extension 268, which serves, among other things, to retard or prevent vertical movement of the LP circuit board first side 272. In one embodiment, the LP circuit board 270 is installed within LP housing interior 212 by tilting LP circuit board 270 such that one of LP circuit board first side 272 and LP circuit board second side 273 are first installed.

The LP cover 250, when affixed or mounted or engaged with the top of the LP housing 210, forms a watertight or waterproof or water-resistant seal such that water or other liquid is prevented or retarded from entering the LP first cavity 202. Note that water entering the LP first cover receiver void 224 would likely rest or engage the LP circuit board 270 causing an electrical malfunction. One or both of the LP cover 250 and LP housing 210, and/or portions thereof, are of a malleable or flexible material so that the engagements described above are enabled. One or more of the engagements between the elements of the LP cover 250 and LP housing 210 are interference fits. For example, the LP cover extension 266, when inserted into LP first cover receiver void 224 and past the two LP first cover receiver grippers 226, may require the LP first cover receiver void 224 to expand (i.e. provide a larger void) to enable an interference fit of the LP cover extension 266 within the LP first cover receiver void 224. Such interference fits assist in preventing or reducing the risk of water penetration into the LP first cover receiver void 224.

The LP cover 250 further comprises an LP cover transparent portion 252 and adjacent LP cover first opaque portion 254 and LP cover second opaque portion 255. Light produced by the LP circuit board 270 is emitted through the LP cover transparent portion 252 and is at least substantially not emitted through each of the LP cover first opaque portion 254 and LP cover second opaque portion 255. LP cover transparent portion 252 is substantially clear. In one embodiment, LP cover transparent portion 252 is polarized and/or colored and/or otherwise treated, e.g. to diffuse received light.

LP circuit board 270 comprises LP circuit board first side 272, LP circuit board second side 273, LP circuit board first connector 282 and LP circuit board second connector 283. LP circuit board first connector 282 comprises a plurality of LP circuit board first connector extended pins 284 and a plurality of LP circuit board first connector nominal pins 286. LP circuit board second connector 283 comprises a plurality of LP circuit board second connector extended pins 285 and a plurality of LP circuit board second connector nominal pins 287. The set of pins on LP circuit board first connector 282 are configured to engage the set of pins on LP circuit board second connector 283, such that a set of two LP circuit boards 270, when aligned end to end, may electrically and/or mechanically communicate. Alternatively, a set of two LP circuit boards 270, when aligned end to end, may be electrically connected through an electrical bundle element (not shown) comprising an LP circuit board first connector 282 at a first end (to engage an LP circuit board second connector 283) and an LP circuit board second connector 283 (to engage an LP circuit board first connector 282) at the other end. The LP circuit board 270 further comprises LP circuit board electronics 293 and three LEDs, i.e. LP circuit board first LED 292, LP circuit board medial LED 294 and LP circuit board second LED 296. Each of the LP circuit board first LED 292, LP circuit board medial LED 294 and LP circuit board second LED 296 are mounted to the LP circuit board 270 such that when the LP circuit board 270 is fitted or engaged with the LP housing 210 and the LP cover 250 is installed to the LP housing 210, each of the LP circuit board first LED 292, LP circuit board medial LED 294 and LP circuit board second LED 296 are positioned below and substantially centered with respect to the LP cover transparent portion 252.

Figure 3A:
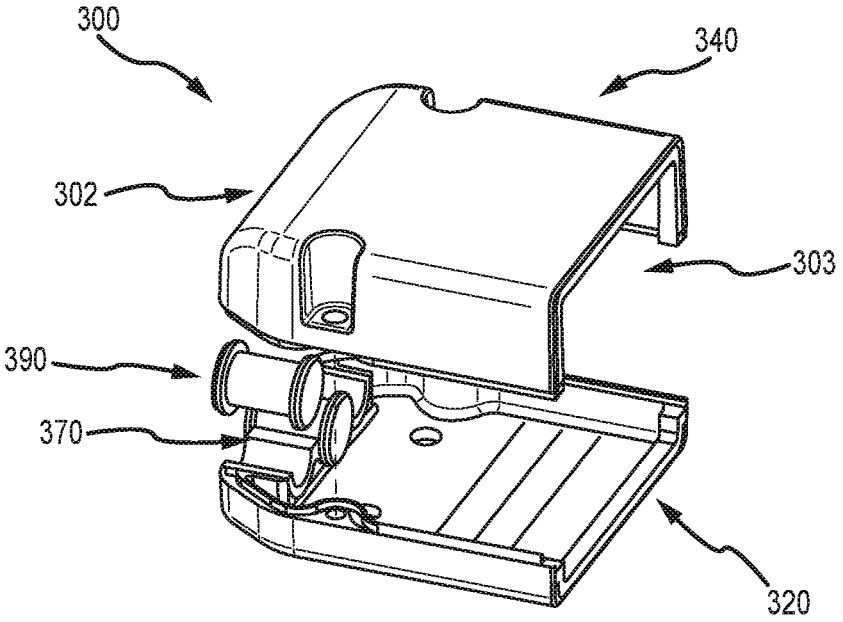
FIG. 3A depicts a perspective view of the termination adaptor portion of the lighting system of FIG. 1A according to one embodiment of the present invention.
Figure 3B:
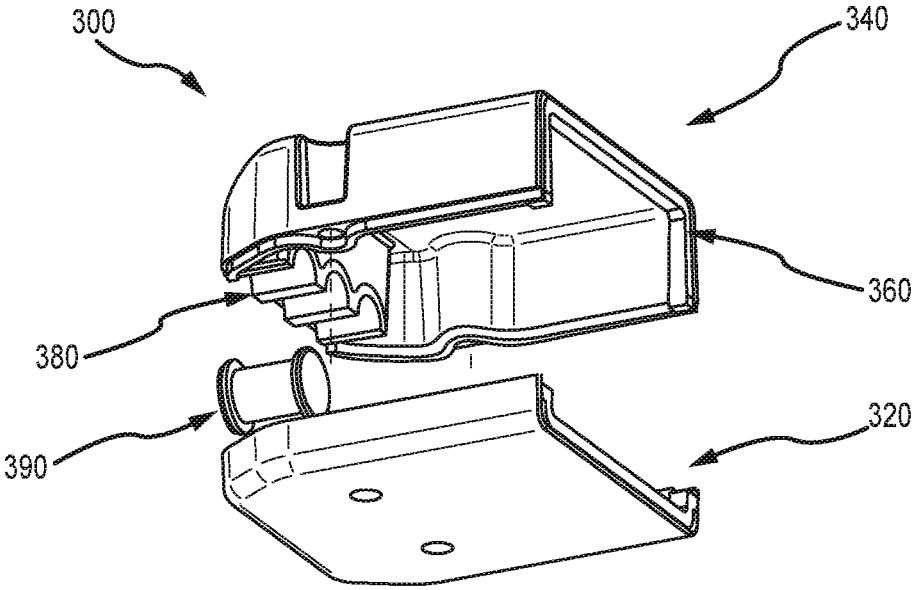
FIG. 3B depicts another perspective view of the termination adaptor portion of the lighting system of FIG. 1A according to one embodiment of the present invention.
Figure 3C:
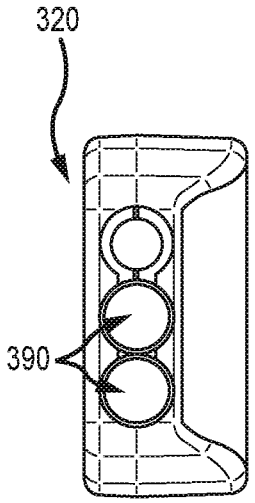
FIG. 3C depicts a front elevation view of the termination adaptor portion of FIG. 3A according to one embodiment of the present invention.
Figure 3D:
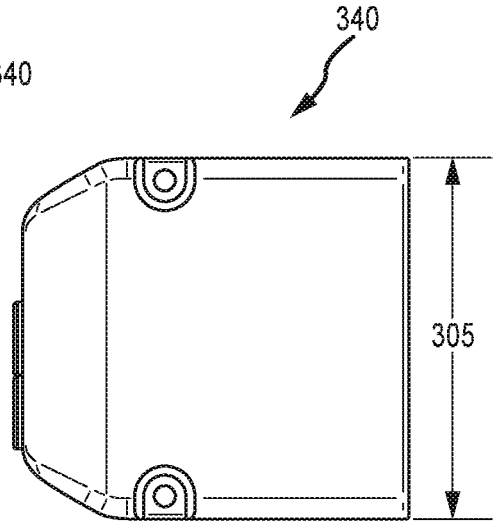
FIG. 3D depicts a top plan view of the termination adaptor portion of FIG. 3A according to one embodiment of the present invention.
Figure 3E:
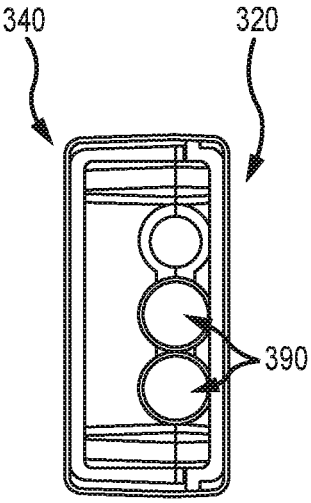
FIG. 3E depicts a rear elevation view of the termination adaptor portion of FIG. 3A according to one embodiment of the present invention.
Figure 3F:
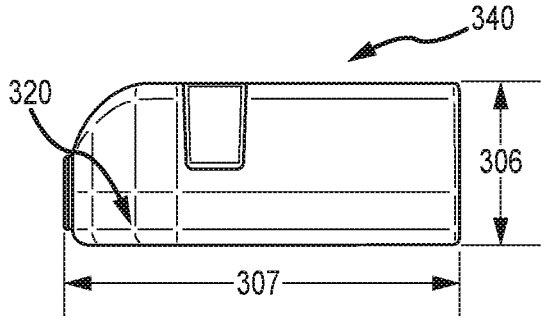
FIG. 3F depicts a left side elevation view of the termination adaptor portion of FIG. 3A according to one embodiment of the present invention.
Figure 3G:
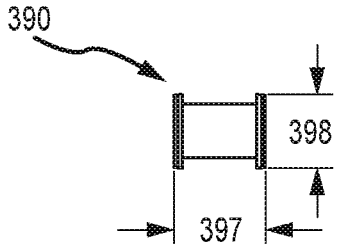
FIG. 3G depicts a left side elevation view of the termination adaptor portion plug of FIG. 3A according to one embodiment of the present invention.
Figure 3H:
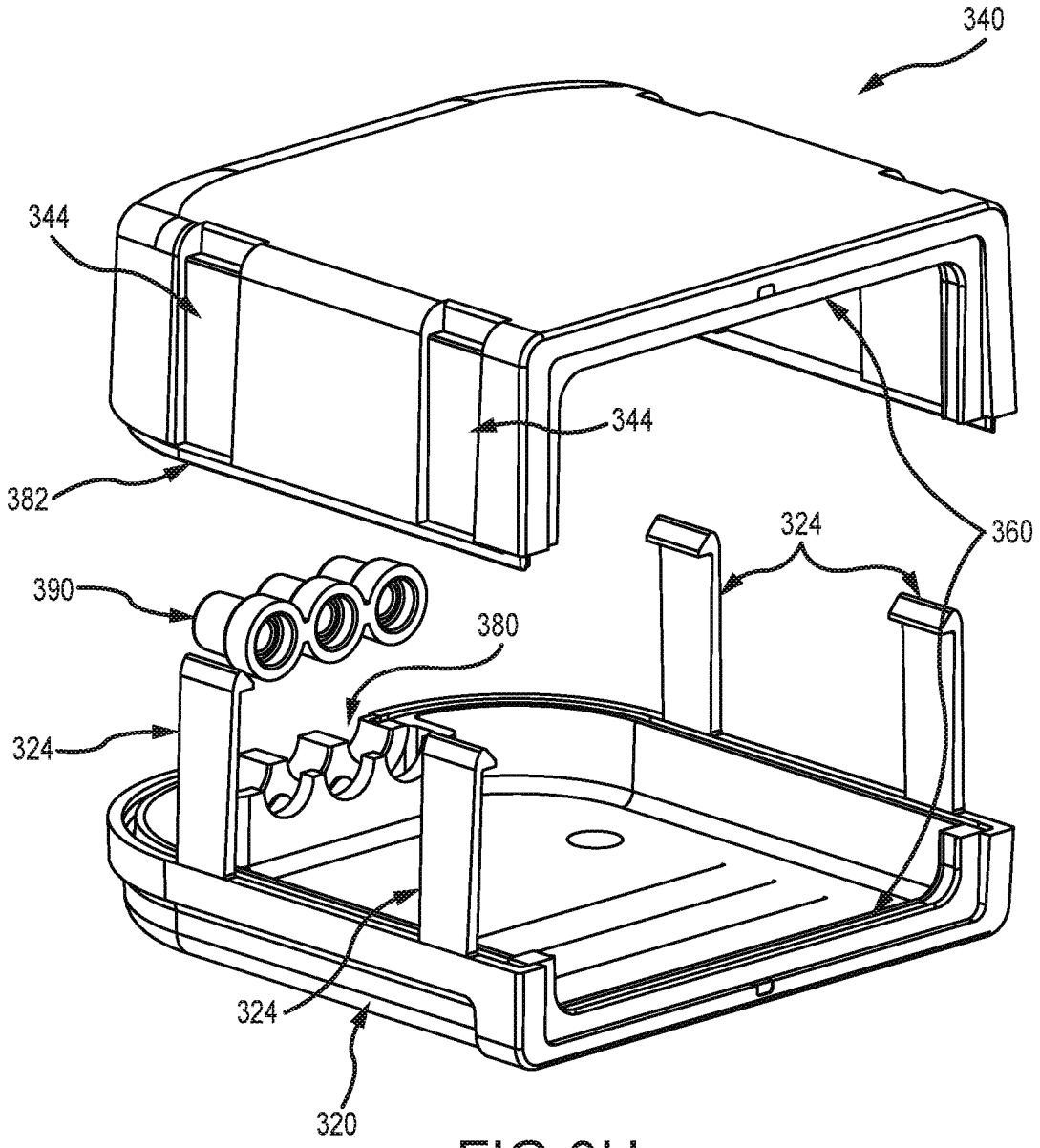
FIG. 3H depicts a perspective view of the termination adaptor portion of the lighting system of FIG. 1A according to another embodiment of the present invention.

With particular attention to FIGS. 3A-H, a termination adapter portion (TAP) 300 is depicted comprising TAP width 305, TAP height 306 and TAP length 307. The termination adapter portion 300 generally comprises a TAP base 320 and a TAP lid 340 which fits on top or above the TAP base 320. The fitting of the TAP base 320 and associated TAP lid 340 creates a watertight or waterproof or water resistant seal at the edges of each respective element. Also, the terminal adaptor portion 300 is configured to fit around or enclose the end of a linear portion 200, and provide a waterproof or watertight or water resistant seal between intersections of the terminal adaptor portion 300 and the linear portion 200. A first embodiment of a termination adapter portion (TAP) 300 is depicted in FIGS. 3A-G. A second embodiment of a termination adapter portion (TAP) 300 is depicted in FIG. 3H.

With respect to the embodiment of the termination adapter portion 300 of FIGS. 3A-3G, the TAP lid 340 fits on top or above the TAP base 320 through a tongue and groove style connection and may be further fitted with a gasket or similar watertight device known to those skilled in the art (e.g. TAP perimeter gasket 382). TAP lid 340 comprises TAP first side 302, TAP second side 303 and TAP end gasket 360. The TAP end gasket 360 enables watertight sealing between the termination adapter portion 300 and the linear portion 200 at TAP second side 303. At TAP first side 302, a plurality of TAP plugs 390 are installed or disposed securely within a TAP main gasket 370 and provide a watertight seal therein. Each TAP plug 390 comprises a TAP plug length 397 and a TAP plug outer diameter 398. FIGS. 3A-E depict the termination adapter portion 300 fitted with two TAP plugs 390, leaving one cavity or aperture at TAP first side 302 unsealed or open. The cavity may used for several purposes, such as to run electrical wire into the terminal adapter portion 300 to, e.g. connect to the LP circuit board 270. Each of the TAP plugs 390 may be selectively removed to allow or enable such connections.

The TAP lid 340 may alternatively be fitted to the TAP base 320 by way of TAP base arms 324 engaged with respective TAP lid arm slots 344, as depicted in the embodiment of the termination adapter portion 300 of FIG. 3H. This embodiment also features an integrated set of three TAP plugs 390, each of which include a reduced diameter aperture (in contrast to the solid TAP plugs 390 of FIGS. 3A-G).

With particular attention to FIGS. 4A-F, an extension adaptor portion 400 is depicted comprising EAP lid 440 and EAP base 420. The extension adaptor portion 400 allows two linear portions 200 to be joined in a watertight and secure manner. When EAP lid 440 and EAP base 420 are joined to form extension adaptor portion 400, extension adaptor portion 400 has EAP length 407, EAP height 406 and EAP width 405. EAP lid 440 and EAP base 420 are joined to form a watertight fit. Extension adaptor portion 400 further comprises EAP end gasket 460

A first embodiment of an extension adaptor portion 400 is depicted in FIGS. 4A-E. EAP lid 440 and EAP base 420 are joined in a tongue and groove manner. An optional gasket may be fitted to all or part of the join between the EAP lid 440 and the EAP base 420. An aperture is provided on adjacent sides of the extension adaptor portion 400 to assist or enable the secure joining of the EAP lid 440 and the EAP base 420. A screw may be inserted through the aligned apertures to join the EAP lid 440 and the EAP base 320. Each of the two linear portions 200 joined within the extension adaptor portion 400 extend into the extension adaptor portion 400 until unable to advance due to the curved flange adjacent the afore-mentioned aperture of the EAP base 420. One or more apertures are disposed on EAP base 420 to facilitate mounting of the extension adaptor portion 400, such as by way of screws.

Figure 4A:
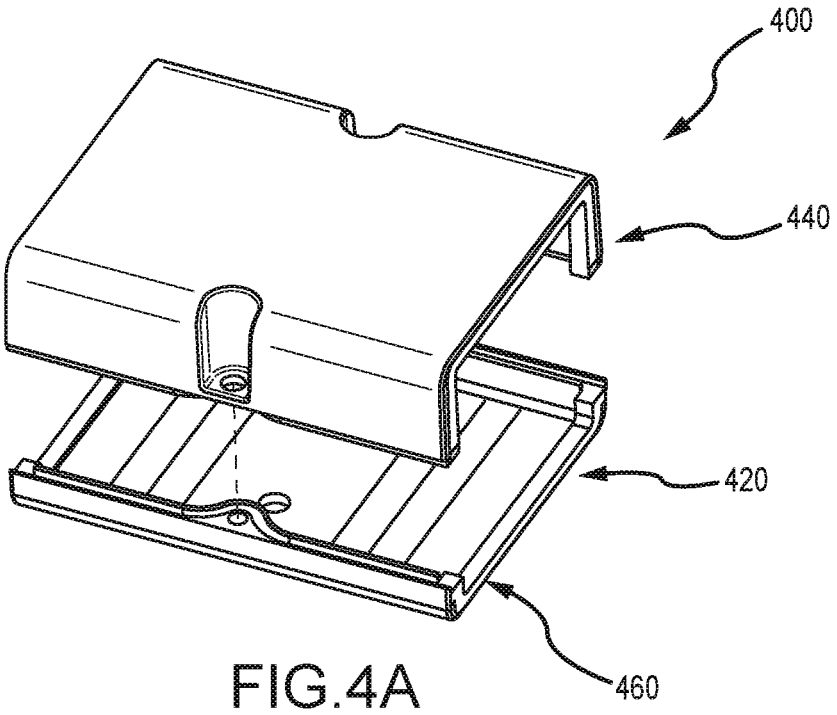
FIG. 4A depicts a perspective view of the extension adaptor portion of the lighting system of FIG. 1A according to one embodiment of the present invention.
Figure 4B:
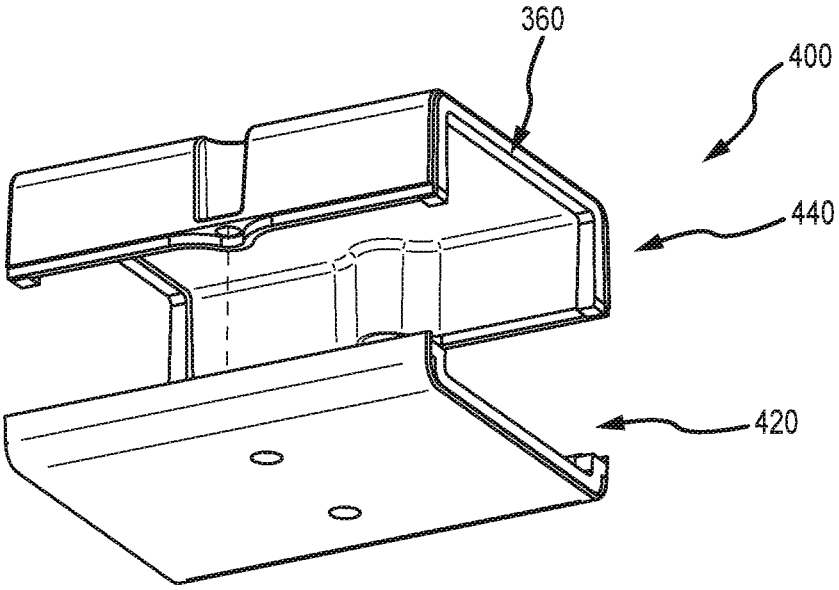
FIG. 4B depicts another perspective view of the extension adaptor portion of the lighting system of FIG. 1A according to one embodiment of the present invention.
Figure 4C:
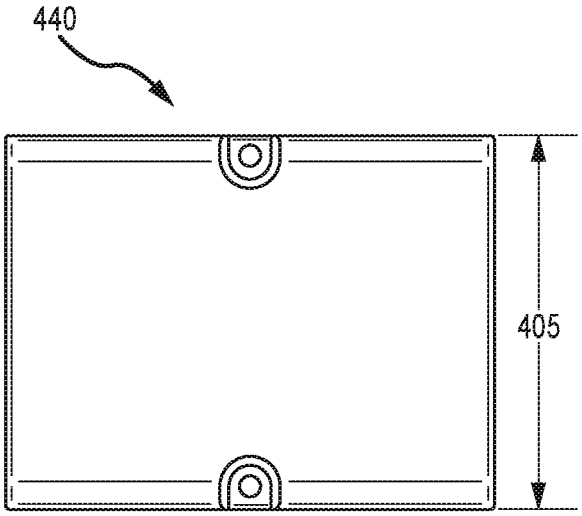
FIG. 4C depicts a top plan view of the extension adaptor portion of FIG. 4A according to one embodiment of the present invention.
Figure 4D:
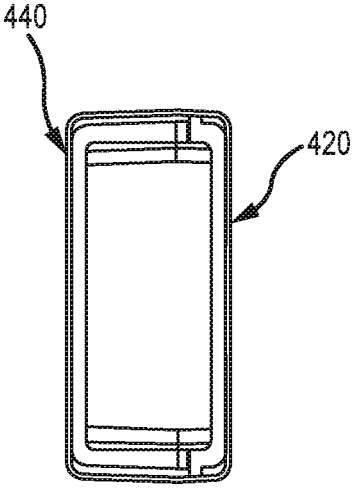
FIG. 4D depicts a rear elevation view of the extension adaptor portion of FIG. 4A according to one embodiment of the present invention.
Figure 4E:
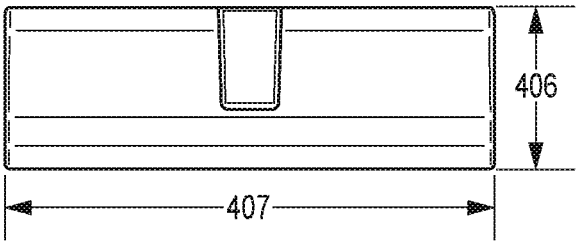
FIG. 4E depicts a right side elevation view of the extension adaptor portion of FIG. 4A according to one embodiment of the present invention.
Figure 4F:
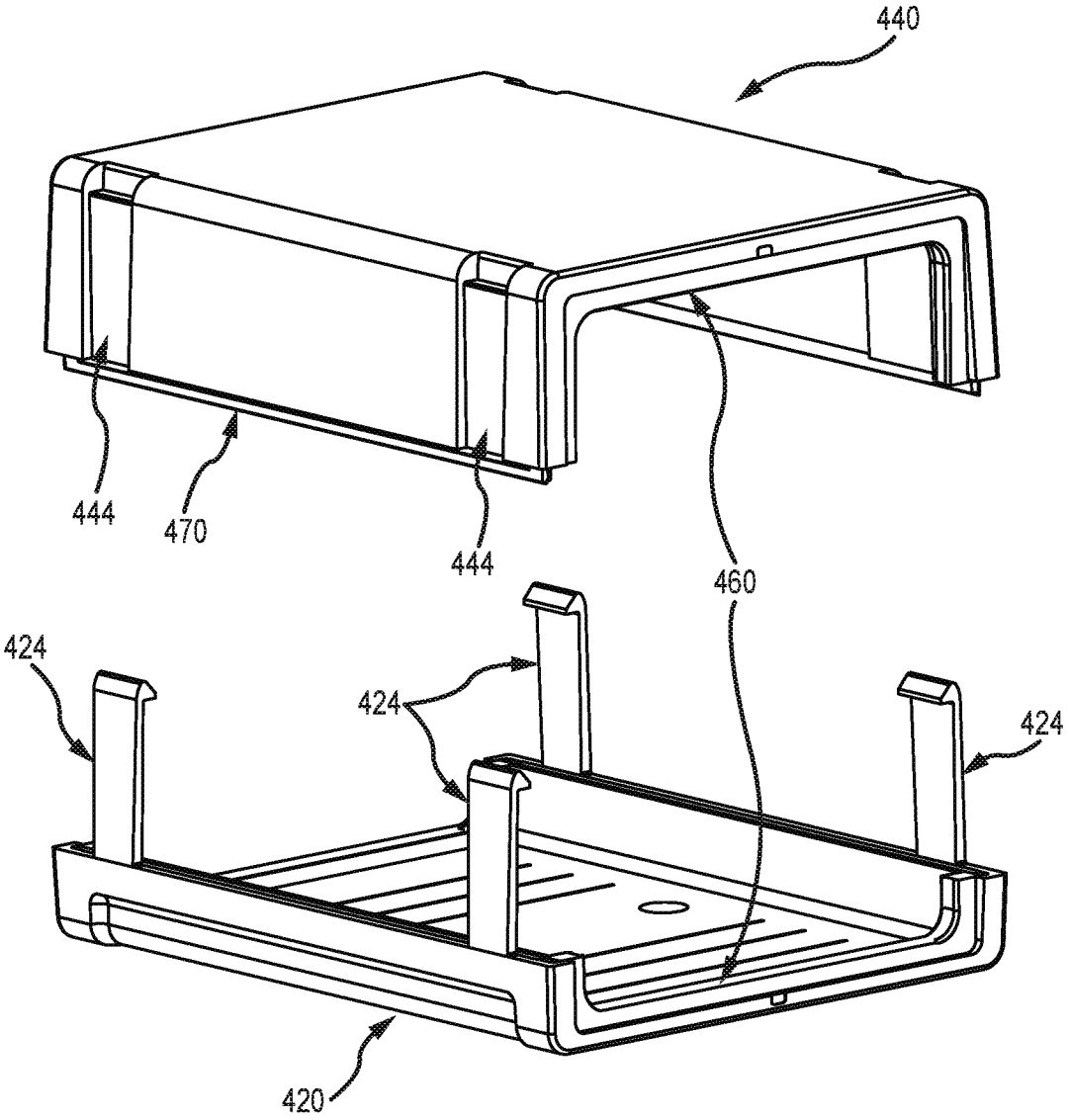
FIG. 4F depicts a perspective view of the extension adaptor portion of the lighting system of FIG. 1A according to another embodiment of the present invention.

A second embodiment of an extension adaptor portion 400 is depicted in FIG. 4F. In this embodiment, the EAP lid 440 and EAP base 420 are joined by way of EAP base arms 424 engaged with respective EAP lid arm slots 444, as depicted in the embodiment of the extension adaptor portion 400 of FIG. 4F.

One of ordinary skill in the art will appreciate that embodiments of the present disclosure may be constructed of materials known to provide, or predictably manufactured to provide, the various aspects of the present disclosure. In one embodiment, the lighting system 100 may be manufactured using methods and techniques comprising injection molding, computer-numeric control (CNC) machining, and 3-D printing. In one embodiment, the lighting system 100 comprises a high rate, Rigid Poly(Vinyl Chloride) (PVC) pellet, extrusion compound. For example, the AP5104B Series of PVC Pellet Compounds as provided by, for example, Aurora Plastics. In one embodiment, the system comprises ASTM D-4216. In one embodiment, the system 100 comprises Rigid Poly (Vinyl Chloride) products.

FIGS. 5A-D provides block diagrams and flow charts of the controller 500 of the system 100. Generally, the controller 500 controls the one or more LP circuit boards 270 of device 100. Such control comprises on/off control, color selection, intensity i.e. brightness control, frequency of light emissions, relative phasing of lights, all with respect to one LP circuit board 270 (i.e. one or more of LP circuit board first LED 292, LP circuit board second LED 296 and/or LP circuit board medial LED 294) or among several LP circuit boards 270.

In one embodiment of the controller 500, the controller 500 comprises a computing media module 510, a master device 520 and one or more slave devices 560. The master device or master board 520 comprises master device network module 530, master device processor 552, master device memory 554 and master device input/output (I/O) circuitry 556. The slave device 560 comprises slave device processor 562, slave device I/O circuitry 556 and slave device PWM (pulse width modulation) and LED circuitry 568. The slave device 560 depicted in FIG. 5A may be connected to one or additional slave devices 560. A communication link 512 connects computing media 510 with the master device 520.

As discussed above, the controller 500 controls the system 100, to include programmable lighting features. In one embodiment, a user may create, edit and/or manage the programmable features (i.e. the user can program custom lighting shows or sequences of the system 100) by way of a user interface (such as a laptop, smart phone or other means known to those skilled in the art) and may access an internet web site or web page. User programmed control instructions are then output to the master device processor 552. The master device processor 552 then determines instructions to control the one or more required slave devices or slave units 560 to implement the user programmed control instructions. In one embodiment, the required individual slave board addresses are established upon system 100 power up and the required programmed instructions are output to the specific slave devices 560. The resulting light show program is stored in local master device memory 554. The master device or master board also comprises necessary interface circuitry 566 to communicate with the slave boards 560.

The one or more slave devices or slave boards 560 use slave device processor 552 to receive and to handle incoming messages from the master device 520. In one embodiment, each particular slave device 560 receives (via slave device I/O circuitry 566) every message or instruction sent by the master device 520 yet only takes action with respect to instructions specifically addressed to or identified as relevant to a particular slave device 560. Once a slave board or device 560 receives a message or instruction, the slave device 560 updates the appropriate display parameter (e.g. color and/or intensity) for each of its LEDs (i.e. one or more of LP circuit board first LED 292, LP circuit board second LED 296 and/or LP circuit board medial LED 294). In one embodiment, each LED is driven by a dedicated PWM circuit to achieve a desired color and intensity.

Figure 5A:
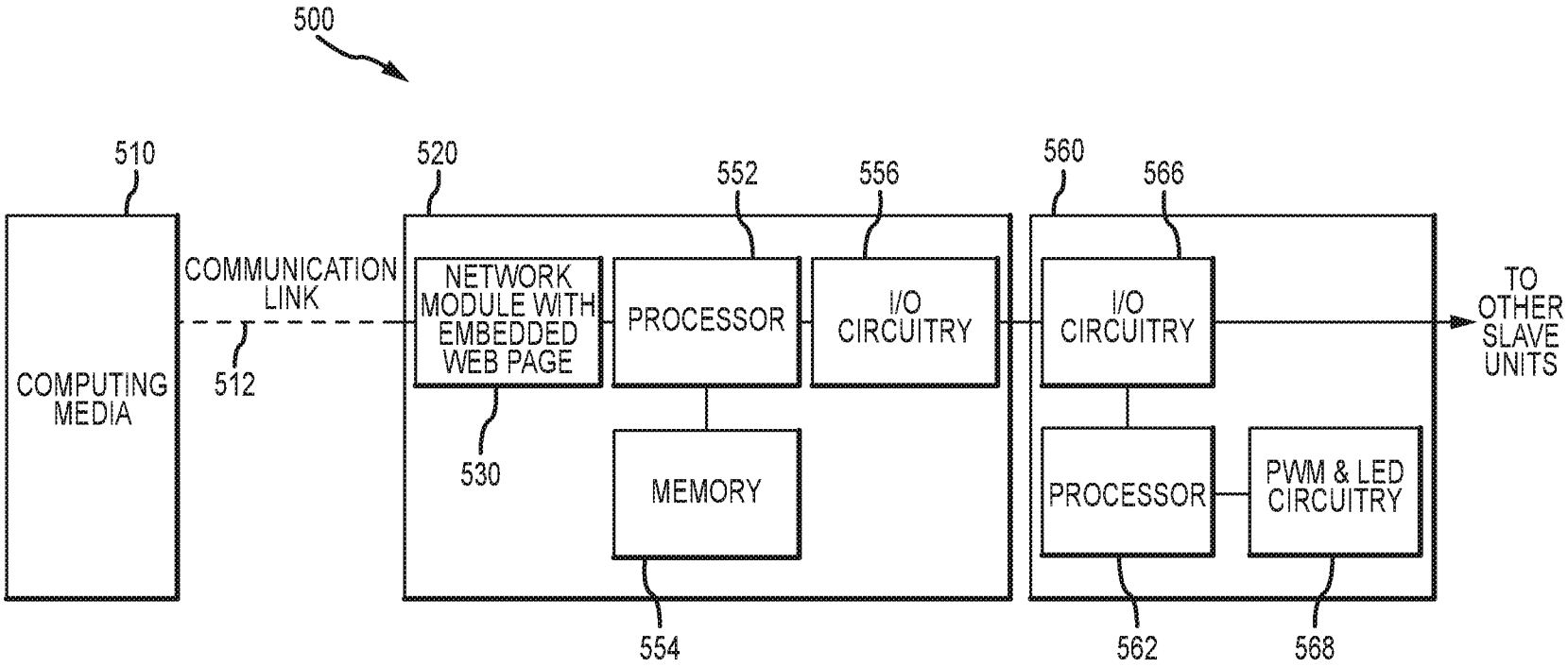
FIG. 5A is a block diagram of the controller portion of the lighting system of FIG. 1A according to one embodiment of the present invention.
Figure 5B:
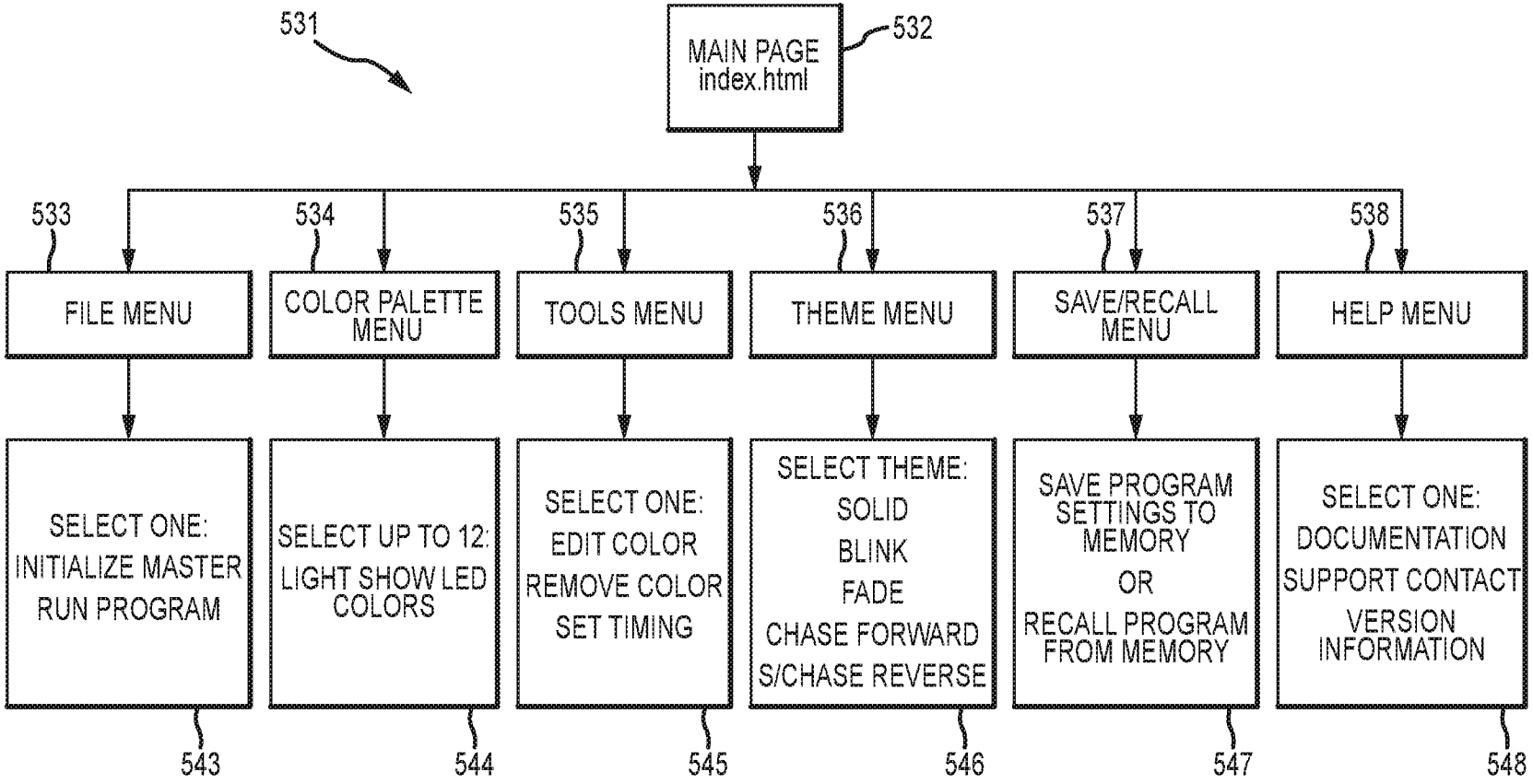
FIG. 5B is a block diagram of the web page portion of the controller portion of FIG. 5A according to one embodiment of the present invention.

A block diagram of an embodiment of the web page portion of the controller 500 of FIG. 5A is depicted in FIG. 5B. Main page 532 comprises a plurality of menus, that is file menu 533 comprising a capability to initialize master run program at module 543, color palette menu 534 comprising a capability to select LED colors at module 544, tools menu 535 comprising a capability to edit and remove colors and set timing at module 545, theme menu 536 comprising the capability to select a theme at module 546, a save/recall menu comprising the capability to save program settings and/or recall a program from memory at module 547, and a help menu 538 comprising the capability to seek documentation at module 548.

Figure 5C:
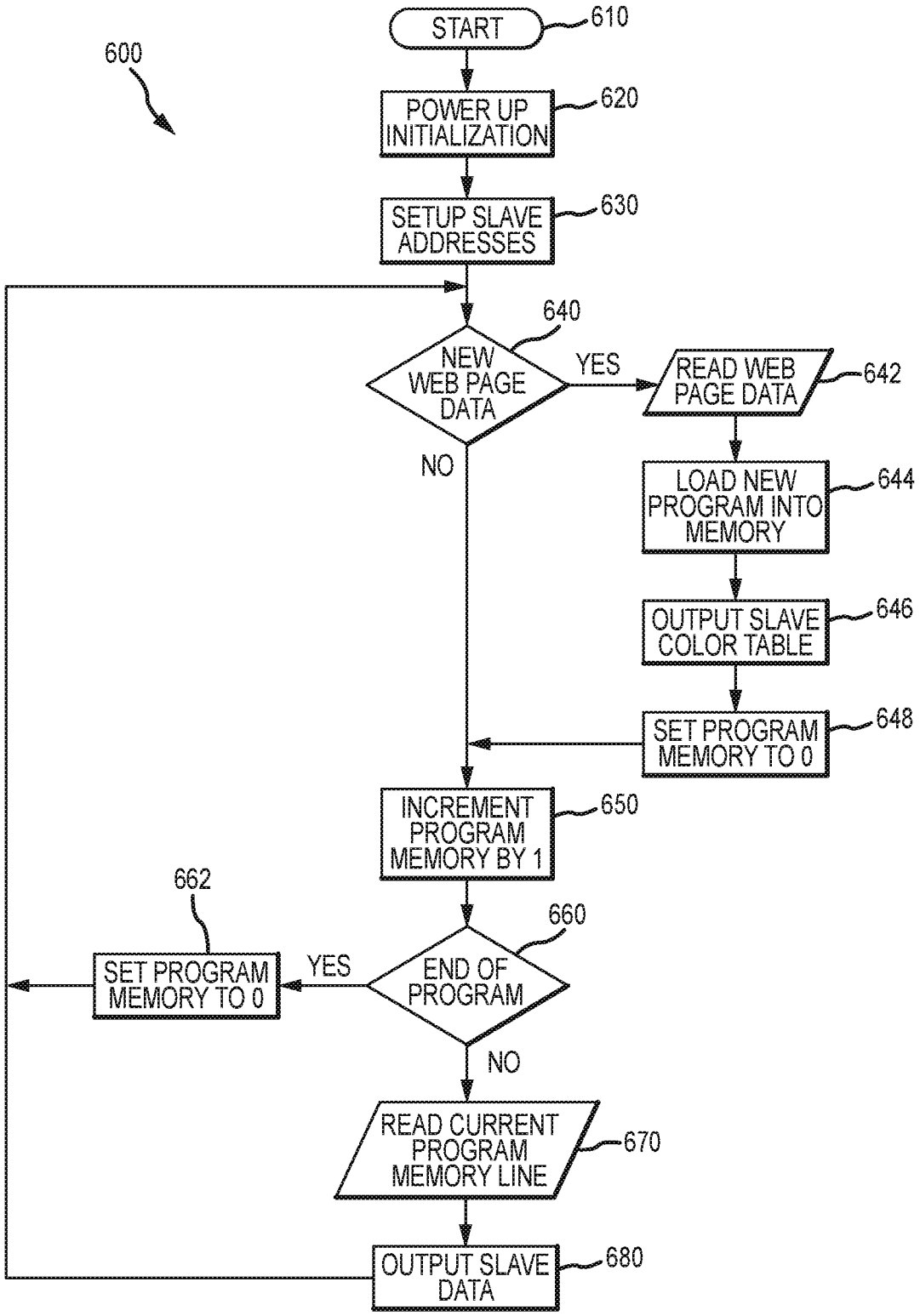
FIG. 5C is a flow chart of the master portion of the controller portion of FIG. 5A according to one embodiment of the present invention.

An embodiment of a method 600 of master device 520 operations is shown in FIG. 5C. While a general order for the steps of the method 600 is shown in FIG. 5C, the method 600 can include more or fewer steps or can arrange the order of the steps differently than those shown in FIG. 5C. Generally, the method 600 starts with a start operation 610. The method 600 can be executed as a set of computer-executable instructions executed by a computer system and encoded or stored on a computer readable medium. Hereinafter, the method 600 shall be explained with reference to the systems, components, modules, software, user interfaces, etc. described in conjunction with FIGS. 5A-B.

At step 620 the master board 520 is powered up and initialization occurs. At step 630, computer addresses of the one or more slave devices 560 are established. At step 640, a query is made to determine if new web page data exists. If yes, then the new web page data is read at step 642, loaded into memory at 644, slave color table is output at step 646, program memory is cleared or zeroed at step 648 and step 650 is entered. If no at step 640, the method 600 continues to step 650.

At step 650 the program memory is incremented by 1 and a query as to whether the end of program has been reached is made at step 660. If yes then program memory is set to zero at step 662 and the method 600 enters step 640. If no at step 660, the method 600 reads current program memory line at step 670 and outputs slave data at step 680, after which the method enters step 640.

Figure 5D:
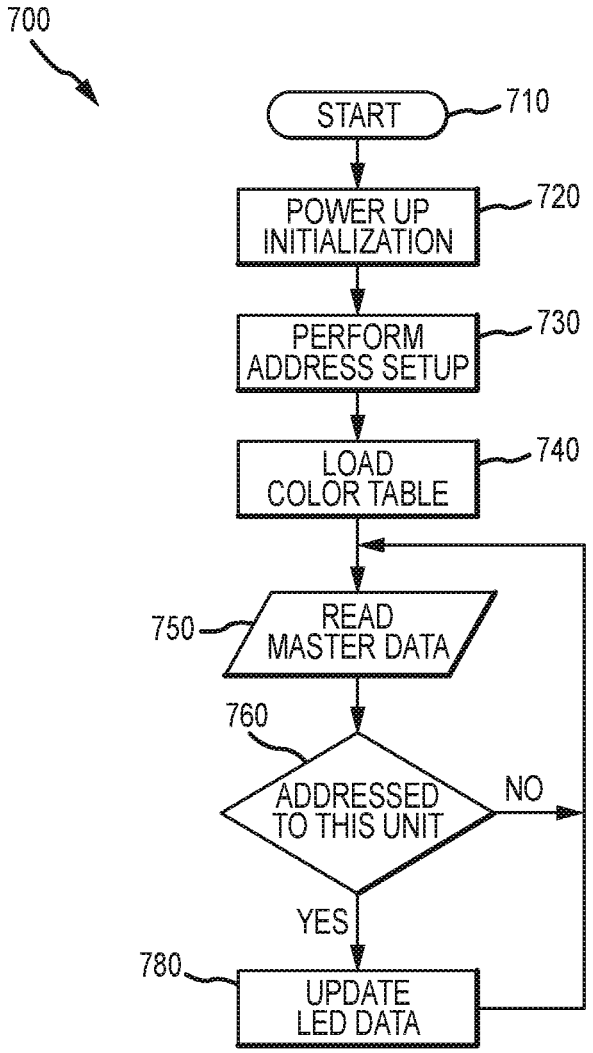
FIG. 5D is a flow chart of the slave portion of the controller portion of FIG. 5A according to one embodiment of the present invention.
Figure 6A:
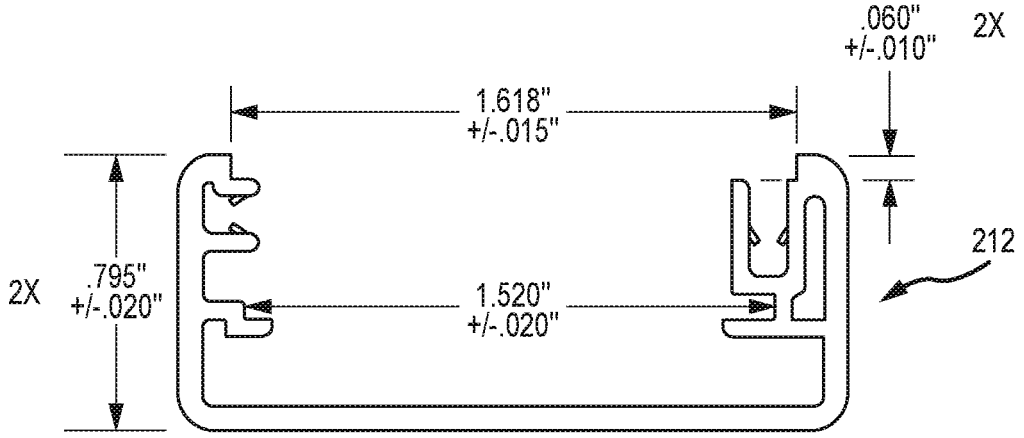
FIG. 6A illustrates a front elevation view of an example construction of a particular embodiment of the housing portion of the lighting system of FIG. 2A—the drawing is to scale with dimensions in inches.
Figure 6B:
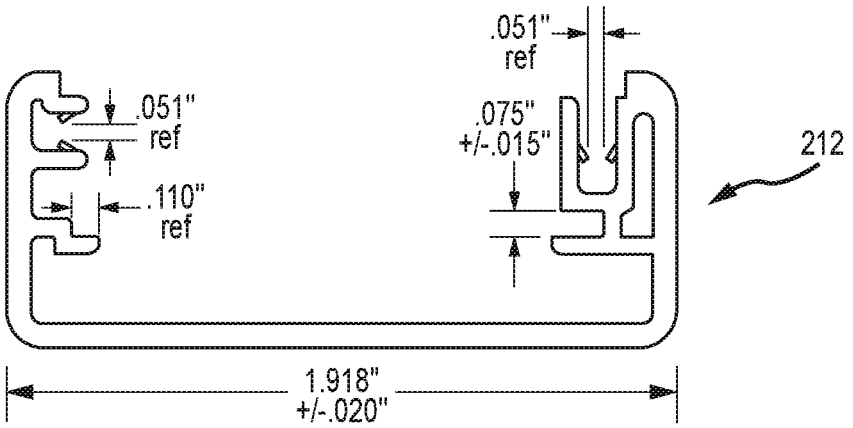
FIG. 6B illustrates an additional front elevation view of the example construction of FIG. 6A of a particular embodiment of the housing portion of the lighting system of FIG. 2A—the drawing is to scale with dimensions in inches.
Figures 6C, 6D, 6E:
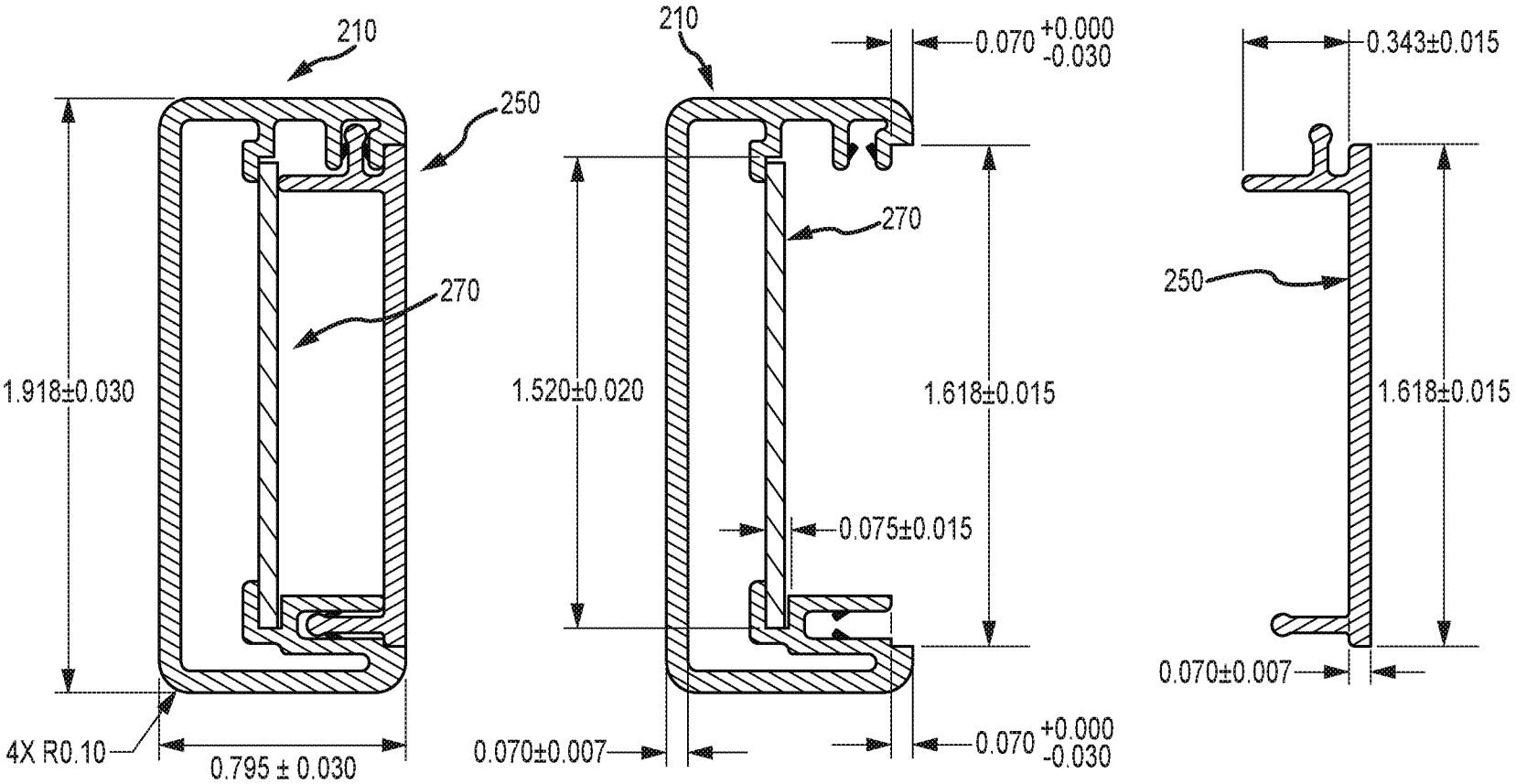
FIG. 6C illustrates a front elevation view of an example construction of a particular embodiment of the housing portion of the lighting system of FIG. 2A as fitted with LP Circuit Board and LP Cover—the drawing is to scale with dimensions in inches.
FIG. 6D illustrates another front elevation view of the example construction of the particular embodiment of the housing portion of the lighting system of FIG. 6C as fitted with an LP Circuit Board—the drawing is to scale with dimensions in inches.
FIG. 6E illustrates another front elevation view of the example construction of the particular embodiment of the LP Cover portion of the lighting system of FIG. 6C—the drawing is to scale with dimensions in inches.
Figure 7A:
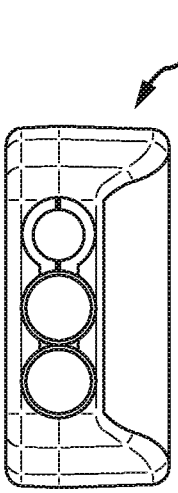
FIG. 7A illustrates a front elevation view of an example construction of a particular embodiment of the termination adaptor portion of FIG. 3A—the drawing is to scale with dimensions in inches.
Figure 7B:
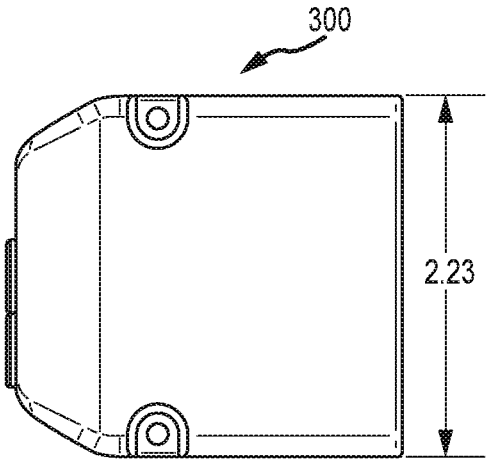
FIG. 7B illustrates a top plan view of the example construction of the particular embodiment of the termination adaptor portion of FIG. 7A—the drawing is to scale with dimensions in inches.
Figure 7C:
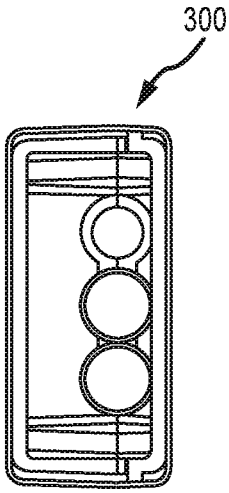
FIG. 7C illustrates a rear elevation view of the example construction of the particular embodiment of the termination adaptor portion of FIG. 7A—the drawing is to scale with dimensions in inches.
Figure 7D:
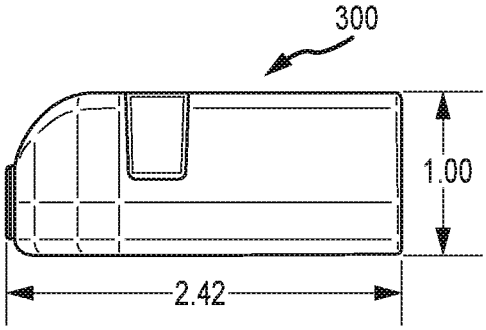
FIG. 7D illustrates a right side elevation view of the example construction of the particular embodiment of the termination adaptor portion of FIG. 7A—the drawing is to scale with dimensions in inches.
Figure 7E:
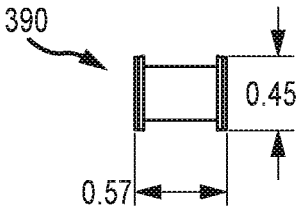
FIG. 7E illustrates a right side elevation view of an example construction of a particular embodiment of the termination adaptor portion plug of FIG. 7A—the drawing is to scale with dimensions in inches.
Figure 7F:
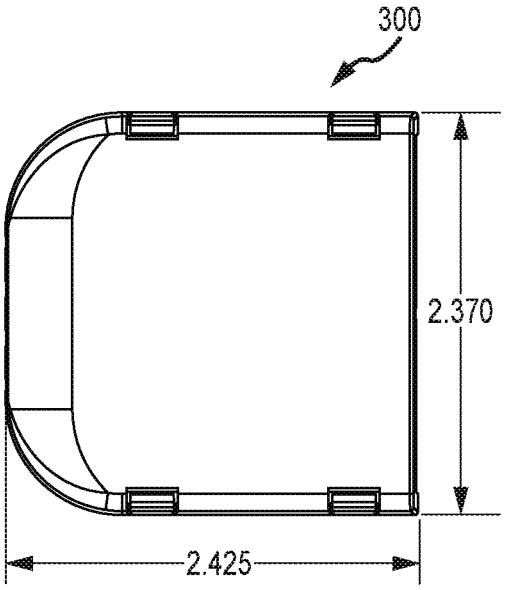
FIG. 7F illustrates a top plan view of another example construction of a particular embodiment of the termination adaptor portion of FIG. 3A—the drawing is to scale with dimensions in inches.
Figure 7G:
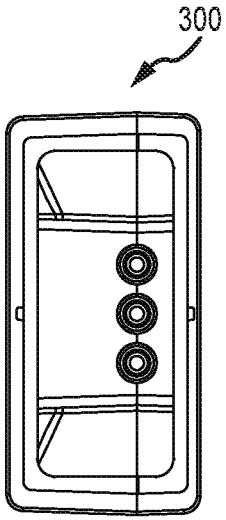
FIG. 7G illustrates a rear elevation view of the example construction of the particular embodiment of the termination adaptor portion of FIG. 7F—the drawing is to scale with dimensions in inches.
Figure 7H:
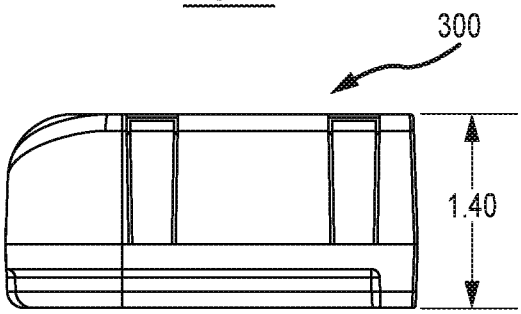
FIG. 7H illustrates a right side elevation view of the example construction of the particular embodiment of the termination adaptor portion of FIG. 7F—the drawing is to scale with dimensions in inches.
Figure 8A:
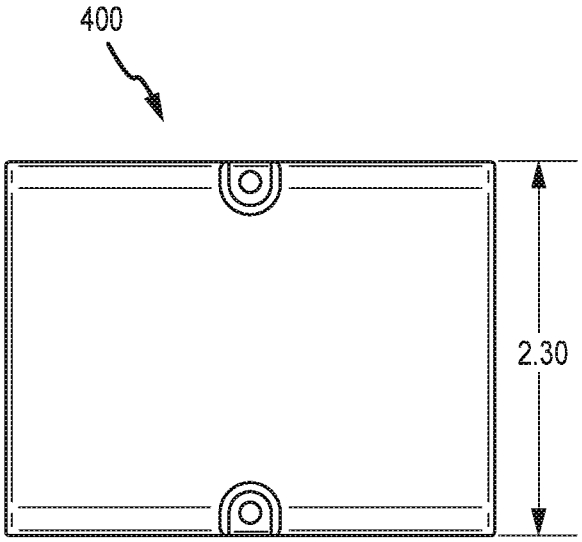
FIG. 8A illustrates a top plan view of an example construction of a particular embodiment of the extension adaptor portion of FIG. 4A—the drawing is to scale with dimensions in inches.
Figure 8B:
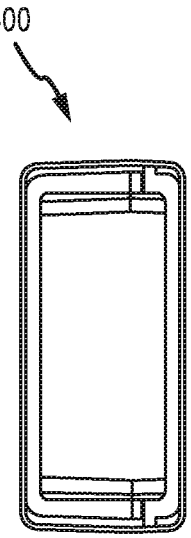
FIG. 8B illustrates a rear elevation view of the example construction of the particular embodiment of the extension adaptor portion of FIG. 8A—the drawing is to scale with dimensions in inches.
Figure 8C:
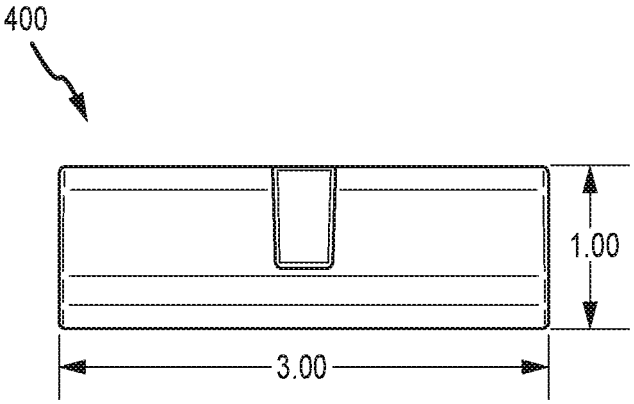
FIG. 8C illustrates a right side elevation view of the example construction of the particular embodiment of the extension adaptor portion of FIG. 8A—the drawing is to scale with dimensions in inches.
Figure 8D:
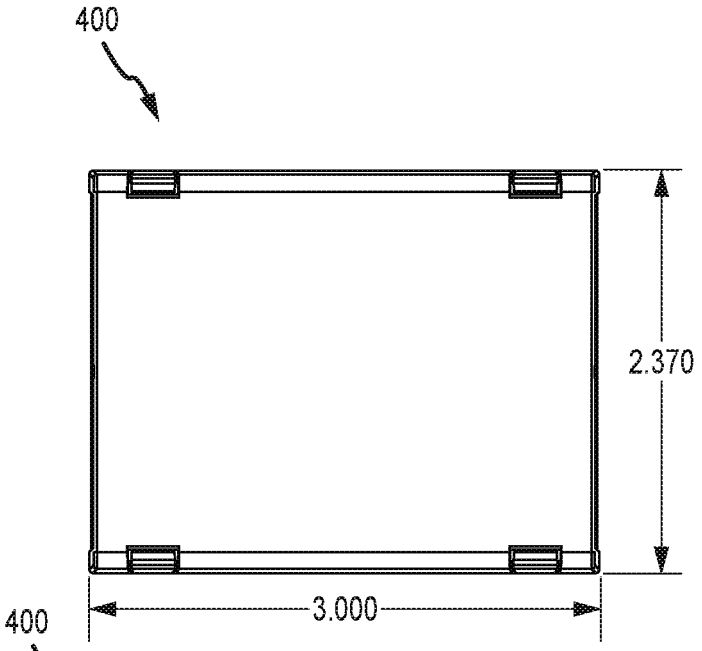
FIG. 8D illustrates a top plan view of another example construction of a particular embodiment of the extension adaptor portion of FIG. 4A—the drawing is to scale with dimensions in inches.
Figure 8E:
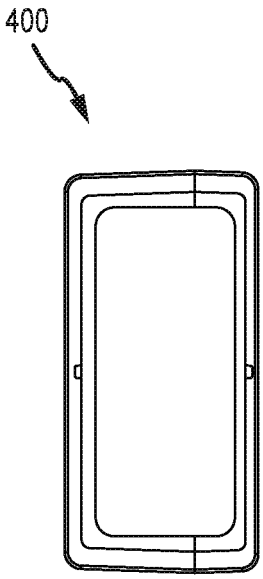
FIG. 8E illustrates a rear elevation view of the example construction of the particular embodiment of the extension adaptor portion of FIG. 8D—the drawing is to scale with dimensions in inches.
Figure 8F:
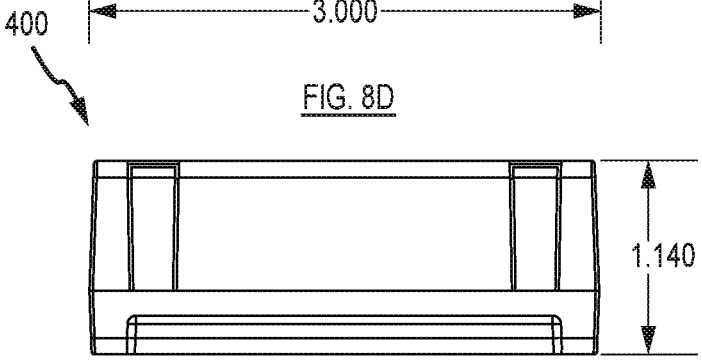
FIG. 8F illustrates a right side elevation view of the example construction of the particular embodiment of the extension adaptor portion of FIG. 8D—the drawing is to scale with dimensions in inches.
Figure 9A:
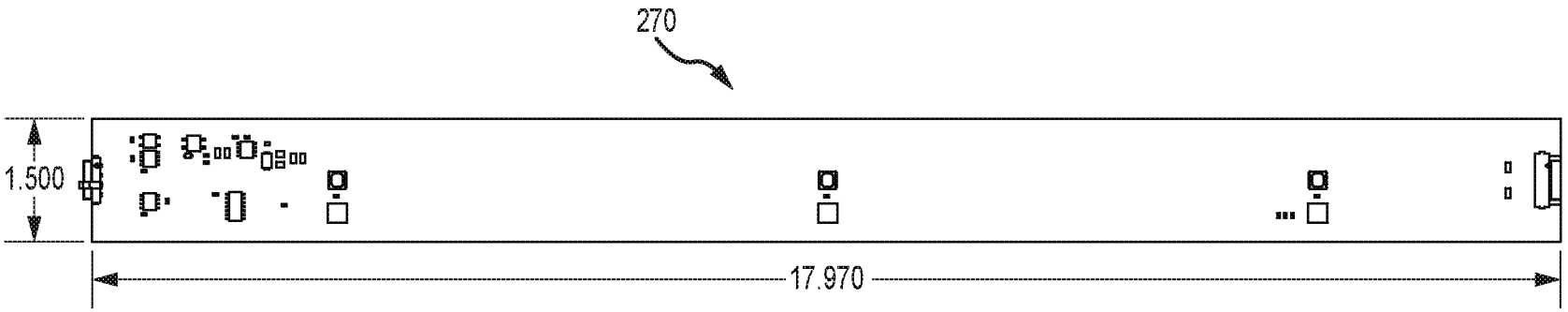
FIG. 9A illustrates a top plan view of an example construction of a particular embodiment of the LP Circuit Board portion of FIG. 2G—the drawing is to scale with dimensions in inches.
Figure 9B:
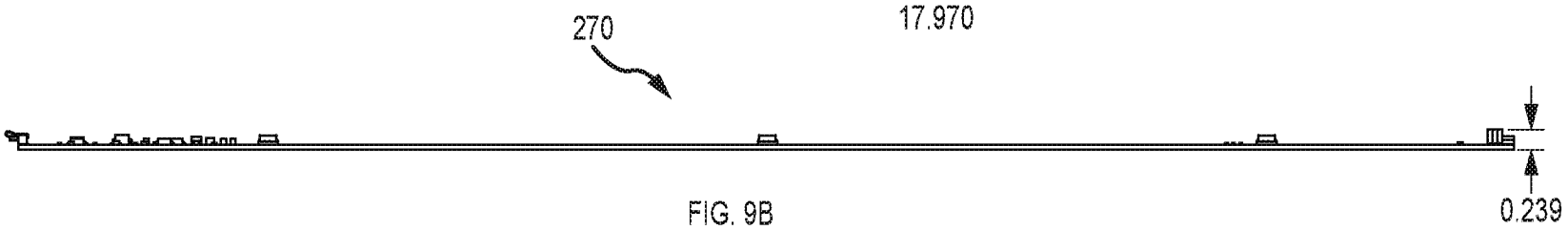
FIG. 9B illustrates a right side elevation view of the example construction of the particular embodiment of the LP Circuit Board of FIG. 9A—the drawing is to scale with dimensions in inches.
Figure 10:
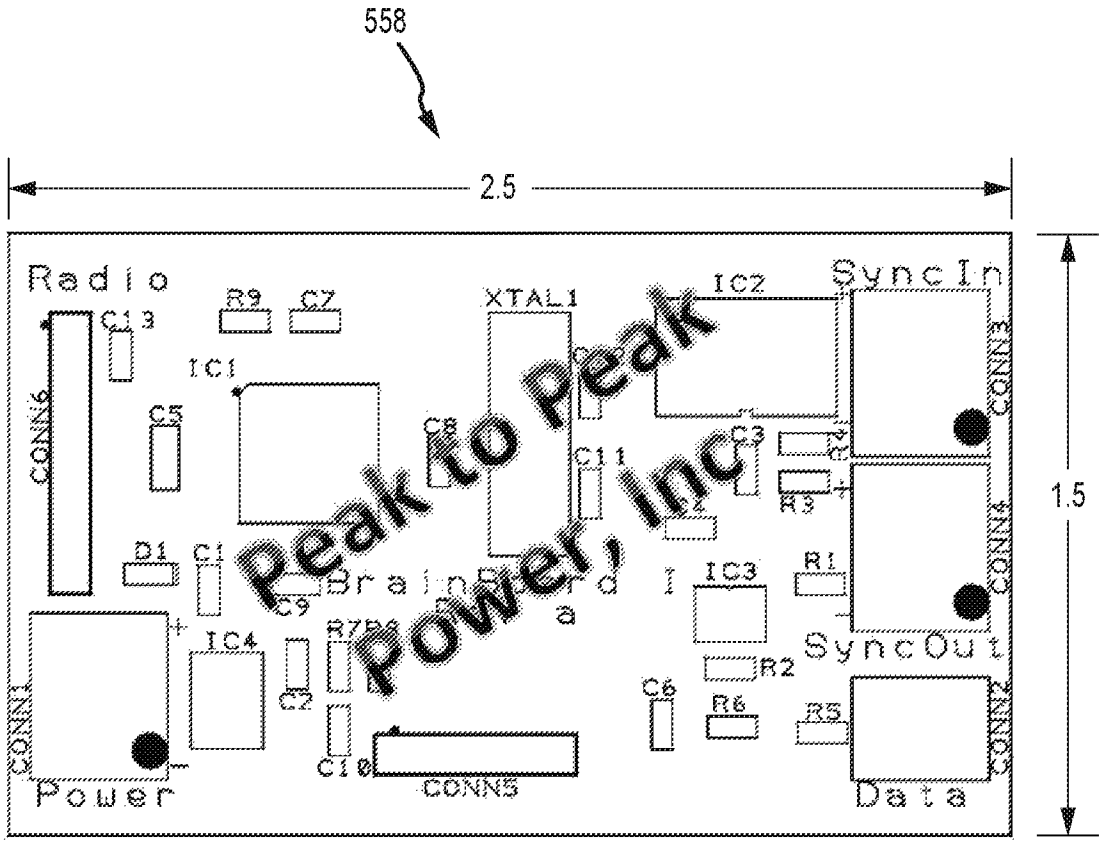
FIG. 10 illustrates a top plan view of an example construction of a particular embodiment of the Master Control Board—the drawing is to scale with dimensions in inches.

An embodiment of a method 700 of slave device 560 operations is shown in FIG. 5D. While a general order for the steps of the method 700 is shown in FIG. 5D, the method 700 can include more or fewer steps or can arrange the order of the steps differently than those shown in FIG. 5D. Generally, the method 700 starts with a start operation 710. The method 700 can be executed as a set of computer-executable instructions executed by a computer system and encoded or stored on a computer readable medium. Hereinafter, the method 700 shall be explained with reference to the systems, components, modules, software, user interfaces, etc. described in conjunction with FIGS. 5A-C.

At step 720, a particular slave board 560 is powered up and initialized. At step 730, computer address set-up is performed. At step 740, color table is loaded. At step 750, master data received is read. At step 760, a query is made as to whether the master data received is addressed to the particular slave unit/board; if no, the method 700 proceeds to step 750, if yes, the method 700 proceeds to step 780 and the slave board's LED data is updated.

In one embodiment, the system 100 comprises components that are permanently mounted to a structure for architectural purposes. In one embodiment, the system 100 is designed to resemble 1"×2" wood trim, as used in many residential houses. In on embodiment, the system 100 may comprise a hollow extrusion comprised of a UV stable, vinyl rear housing and a co-extruded acrylic lens that snaps into place, securing the circuit board/PCB assembly and providing for a water resistant enclosure.

In one embodiment, the lens and housing may be pigmented to match a particular home trim color, and/or the co-extruded lens provides for an opaque center lens for the LED light to illuminate through, yet the upper and lower portion of the lens may be pigmented to match the rear housing. In one embodiment, the extrusion (i.e. the linear portion 200) has enough room located below the LP circuit board 270 (i.e. the LP second cavity 204) to allow other wires to be run, effectively making the linear portion 200 a useful cable raceway for other architectural components such as satellite dish wires, etc.

In another embodiment, the extrusion lengths (of linear portion 200) may be terminated via an ABS molded end cap and ABS molded connectors will serve the purpose of connecting 12 ft lengths of (linear portion 200) extrusions end to end for long runs. In one embodiment, the PCB/LED assembly is made of rigid fiberglass boards with 3 RGB, LED's per 18" circuit board, however the linear portion 200 could easily be converted to use a flex tape PCB based system or similar as known to those skilled in the art.

In yet another embodiment, embodiments of the system 100 comprise: 1) single color (LED) only; 2) multiple color (LED) with push button momentary switch control for controller 500; and 3) multiple color with custom control via web interface and custom color options for team colors, etc.

In one embodiment, the system comprises a structure that is UV stable and includes a vinyl rear housing. In one embodiment, the system comprises a co-extruded acrylic lens that snaps into place and a water-proof or water-resistant structure. In one embodiment, the lens is co-extruded and comprises an opaque center lens and a pigmented upper and/or lower lens. In one embodiment, the system comprises rigid fiberglass boards and flex-tape PCB-based designs.

In one embodiment, the system comprises motion sensors such as down-lights, on/off ambient light sensors, an emergency flashing mode, an audio e.g. alarm feature, and a fire or smoke warning feature. In one embodiment, the system engages power supplies comprising 24 volt and 120 volt. In one embodiment, the system employs pulse width modulation.

In one embodiment, one or more elements, such as the linear portion 200, are manufactured by way of 3-D printing or extrusion. In one embodiment, the entire mounted system 100 is water resistant or water proof. In one embodiment, one or more of the LP Cover Transparent Portion 252, LP Cover First Opaque Portion 254 and LP Cover Second Opaque Portion 255 are pigmented completed or at least one of an upper and a lower lens portion. In one embodiment, one or more of the LP Cover Transparent Portion 252, LP Cover First Opaque Portion 254 and LP Cover Second Opaque Portion 255 are a co-extruded acrylic lens. In one embodiment, the elements of the system 100 comprise UV stable materials and/or materials that may be painted.

In one embodiment of the system 100, one or more of the LP circuit board first LED 292, LP circuit board second LED 294 and LP circuit board third LED 296 are not LEDs and instead comprise fiber optic, bioluminescent, electroluminescent and fluorescent sources.

In one embodiment, the controller 500 is configured to communicate and/or integrate with one or more of motion sensors, light sensors, emergency sensors such as alarms, audio devices such as speakers, and fire warning systems. In another embodiment, the system is configured to produce an addressable display, e.g. an alphanumeric static or dynamic display.

One of ordinary skill in the art will appreciate that embodiments of the present disclosure may be used in applications other than the exterior of structures such as buildings. For example, in one embodiment the system 100 may be used in interior lighting such as cabinet lighting. In one embodiment, the system 100 comprises ultraviolet (UV) light for use in any application known to those skilled in the art, to include plant growth, optical scanning e.g. for barcodes, disinfection, forensic analysis, medical imaging e.g. imaging of cells, curing of polymers or printer inks, insect control (aka "bug zappers"), and photography. In one embodiment, the UV elements are instead UV detectors, providing a means to provide fire detection.

In another embodiment, the system 100 comprises infrared (IR) light for use in any application known to those skilled in the art, to include surveying/monitoring applications e.g. as part of a security system with or without surveillance cameras, thermography, tracking, meteorology and health hazard monitoring.

In yet another embodiment, the system 100 comprises one or more lighting elements in the electromagnetic spectrum, such as UV and IR bands.

The exemplary systems and methods of this disclosure have been described in relation to a lighting system disposed in an exterior residential home environment and associated devices. However, to avoid unnecessarily obscuring the present disclosure, the preceding description omits a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Furthermore, while the exemplary aspects, embodiments, options, and/or configurations illustrated herein show the various components of the system collocated, certain components of the system can be located remotely, at distant portions of a distributed network, such as a LAN and/or the Internet, or within a dedicated system. Thus, it should be appreciated, that the components of the system can be combined in to one or more devices, such as a Personal Computer (PC), laptop, netbook, smart phone, Personal Digital Assistant (PDA), tablet, etc., or collocated on a particular node of a distributed network, such as an analog and/or digital telecommunications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a PBX and media server, gateway, in one or more communications devices, at one or more users' premises, or some combination thereof. Similarly, one or more functional portions of the system could be distributed between a telecommunications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

Optionally, the systems and methods of this disclosure can be implemented in conjunction with a special purpose computer, a programmed microprocessor or microcontroller and peripheral integrated circuit element(s), an ASIC or other integrated circuit, a digital signal processor, a hardwired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. In one embodiment, the system comprises one more digital multiplex (DMX) controllers. In one embodiment, the system comprises a digital serial interface (DSI) controller, a digital addressable lighting interface (DALI), and KNX controller. In one embodiment, the system comprises any wired lighting control system known to those skilled in the art. In one embodiment, the system comprises any wireless lighting control system known to those skilled in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In one embodiment, the system is powered by any means known to those skilled in the art, to include electric, solar, mechanical, wind, battery to include lithium battery power, hydro, oil, coal and natural gas. In one embodiment, the system is at least partially powered by photovoltaic (PV) means to generate electricity, such as through one or more solar panels. In one embodiment, the system is substantially powered through direct (i.e. wired) connections. In one embodiment, the system is at least partially powered through wireless means (i.e. without using wires or conductors), such as by wireless power transfer (WPT) and wireless energy transmission means, by any of non-radiative (or near-field) and radiative (or far-field) means.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized. In one embodiment, the disclosed methods may be implemented partially or fully with cloud-based computing resources or techniques and/or shared computing resources, services and/or infrastructure.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter. Examples of the processors as described herein may include, but are not limited to, at least one of Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® dAtom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJ-S™ processors, other industry-equivalent processors, and may perform computational functions using any known or future-developed standard, instruction set, libraries, and/or architecture.

EXAMPLE

Without intending to limit the scope of the invention, FIGS. 6-10 depict several example constructions of particular embodiments of the invention in drawings each to scale. Dimensions are in inches.

As will be appreciated, it would be possible to provide for some features of the inventions without providing others.

To provide further clarity to the Detailed Description provided herein in the associated drawings, the following list of components and associated numbering are provided.

| Ref. No. | Component |
|---|---|
| 10 | Building |
| 20 | Fascia |
| 30 | Eave |
| 40 | Building Surface |
| 50 | Building Roof |
| 60 | Wall |
| 62 | Overhang |
| 100 | Lighting System Device |
| 200 | Linear Portion (LP) |
| 202 | LP First Cavity |
| 204 | LP Second Cavity |
| 210 | LP Housing |
| 212 | LP Housing Interior |
| 222 | LP First Cover Shelf Mount |
| 223 | LP Second Cover Shelf Mount |
| 224 | LP First Cover Receiver Void |
| 225 | LP Second Cover Receiver Void |
| 226 | LP First Cover Receiver Gripper |
| 227 | LP Second Cover Receiver Gripper |
| 232 | LP First Circuit Board Shelf Mount |
| 233 | LP Second Circuit Board Shelf Mount |
| 250 | LP Cover |
| 252 | LP Cover Transparent Portion |
| 254 | LP Cover First Opaque Portion |
| 255 | LP Cover Second Opaque Portion |
| 262 | LP Cover First Shelf |
| 263 | LP Cover Second Shelf |
| 264 | LP Cover First Horizontal Void |
| 266 | LP Cover Extension |
| 268 | LP Cover First Vertical Extension |
| 269 | LP Cover Second Vertical Extension |
| 270 | LP Circuit Board |
| 272 | LP Circuit Board First Side |
| 273 | LP Circuit Board Second Side |
| 282 | LP Circuit Board First Connector |
| 283 | LP Circuit Board Second Connector |
| 284 | LP Circuit Board First Connector Extended Pin |
| 285 | LP Circuit Board Second Connector Extended Pin |
| 286 | LP Circuit Board First Connector Nominal Pin |
| 287 | LP Circuit Board Second Connector Nominal Pin |
| 292 | LP Circuit Board First LED |
| 293 | LP Circuit Board Electronics |
| 294 | LP Circuit Board Medial LED |
| 296 | LP Circuit Board Second LED |
| 300 | Termination Adapter Portion (TAP) |
| 302 | TAP First Side |
| 303 | TAP Second Side |
| 305 | TAP Width |
| 306 | TAP Height |
| 307 | TAP Length |
| 320 | TAP Base |
| 324 | Tap Base Arm |
| 340 | TAP Lid |
| 344 | TAP Lid Arm Slot |
| 360 | TAP End Gasket |
| 370 | TAP Main Gasket |
| 380 | TAP Wire Gasket |
| 382 | TAP Perimeter Gasket |
| 390 | TAP Plug |
| 397 | TAP Plug Length |
| 398 | TAP Plug Outer Diameter |
| 400 | Extension Adaptor Portion (EAP) |
| 405 | EAP Width |
| 406 | EAP Height |
| 407 | EAP Length |
| 420 | EAP Base |
| 422 | EAP Mounting Screw |
| 424 | EAP Base Arm |
| 440 | EAP Lid |
| 444 | EAP Lid Arm Slot |
| 460 | EAP End Gasket |
| 470 | EAP Side Gasket |
| 500 | Controller |
| 510 | Computing Media |
| 512 | Communication Link |
| 520 | Master Device |
| 530 | Master Device Network Module |
| 552 | Master Device Processor |
| 554 | Master Device Memory |

-continued

| Ref. No. | Component |
|---|---|
| 556 | Master Device I/O Circuitry |
| 558 | Master Device Control Board |
| 560 | Slave Device |
| 562 | Slave Device Processor |
| 566 | Slave Device I/O Circuitry |
| 568 | Slave Device PWM and LED Circuitry |

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A lighting system, comprising:

a housing with a first receiver void and a second receiver void;

a cover with a first extension adapted to engage the first receiver void and a second extension adapted to engage the second receiver void, the housing and the cover forming a cavity when assembled;

wherein the cover further comprises:

a first opaque portion with the first extension projecting into the cavity;

a second opaque portion with the second extension projecting into the cavity; and a transparent portion that is generally planar positioned between the first and second opaque portions; and at least one lighting source configured to fit within the cavity, wherein the light source is adapted to be controlled for lighting parameters.

2. The system of claim 1, wherein the housing comprises at least two shelf mounts extending into the cavity, the at least two shelf mounts configured to engage a circuit board including the at least one lighting source.

3. The system of claim 2, wherein a portion of the first extension is operable to retard movement of the circuit board.

4. The system of claim 1, wherein:

an exterior surface of the cover is generally planar; and the housing includes a first sidewall, a second sidewall, and a base-wall extending between the first and second sidewalls, wherein the first and second sidewalls are generally parallel.

5. The system of claim 1, wherein the housing and the cover define a first end configured to engage an extension adaptor having a lid interconnectable to a base with a passage therethrough, the passage to receive at least a portion of the housing and the cover therein.

6. The system of claim 1, wherein the at least one lighting source comprises at least three LED lighting sources.

7. The system of claim 6, wherein the at least three LED lighting sources are configured to emit at least three colors.

8. The system of claim 1, wherein:

the first receiver void is oriented transverse to a first sidewall of the housing; and the second receiver void is oriented generally parallel to a second sidewall of the housing.

9. The system of claim 6 or 7, further comprising a controller operable to individually control lighting parameters of the at least three LED lighting sources.

10. The system of claim 1, 6 or 7, wherein the lighting parameters comprise color and intensity, and wherein the lighting parameters are stored on a non-transitory computer readable medium.

11. The system of claim 1, wherein the housing further comprises a first circuit board mount and a second circuit board mount which are configured to engage a circuit board [[including the at least one LED]].

12. The system of claim 11, wherein one of the first circuit board mount and the second circuit board mount forms a cavity.

* * * * *